US008658877B1

(12) United States Patent
Bowser et al.

(10) Patent No.: US 8,658,877 B1
(45) Date of Patent: Feb. 25, 2014

(54) LIGHTING SYSTEMS AND RELATED METHODS

(71) Applicant: Retinal 3D, LLC, Mesa, AZ (US)

(72) Inventors: Roger C. Bowser, Mesa, AZ (US); Lawrence A. Neal, Jr., Mesa, AZ (US)

(73) Assignee: Retinal 3-D, L.L.C., Mesa, AZ (US)

( * ) Notice: Subject to any disclaimer, the term of this patent is extended or adjusted under 35 U.S.C. 154(b) by 0 days.

(21) Appl. No.: 13/894,328

(22) Filed: May 14, 2013

Related U.S. Application Data

(62) Division of application No. 12/837,261, filed on Jul. 15, 2010, now Pat. No. 8,440,899.

(60) Provisional application No. 61/225,689, filed on Jul. 15, 2009, provisional application No. 61/227,021, filed on Jul. 20, 2009, provisional application No. 61/229,685, filed on Jul. 29, 2009.

(51) Int. Cl.
*A63H 5/00* (2006.01)

(52) U.S. Cl.
USPC ..... 84/609

(58) Field of Classification Search
USPC ..... 84/609
See application file for complete search history.

(56) References Cited

U.S. PATENT DOCUMENTS

| | | | | |
|---|---|---|---|---|
| 2,343,691 | A | 3/1944 | Miller | |
| 3,011,744 | A | 12/1951 | Morgan, Jr. | |
| 4,056,805 | A | 11/1977 | Brady | |
| 4,241,295 | A | 12/1980 | Williams, Jr. | |
| 4,428,039 | A | 1/1984 | Gulmond et al. | |
| 4,666,109 | A | 5/1987 | Fallon et al. | |
| 4,797,795 | A | 1/1989 | Callahan | |
| 4,842,535 | A | 6/1989 | Velke, Sr. et al. | |
| 5,291,092 | A | 3/1994 | Coushaine | |
| 5,728,960 | A * | 3/1998 | Sitrick | 84/477 R |
| 5,797,675 | A | 8/1998 | Tanner, Jr. | |
| 6,417,439 | B2 | 7/2002 | Uehara et al. | |
| 7,045,698 | B2 | 5/2006 | Miyamoto | |
| 7,219,931 | B2 | 5/2007 | Kato | |

(Continued)

FOREIGN PATENT DOCUMENTS

JP 2006260893 9/2006

OTHER PUBLICATIONS

E.M. Bazelyan and Yu. P. Raizer: translated by L.N. Smirnova, "Spark Discharge", CRC Press LLC, 1998. ISBN: 0-8493-2868-3.

(Continued)

*Primary Examiner* — Jianchun Qin
(74) *Attorney, Agent, or Firm* — Booth Udall Fuller, PLC

(57) ABSTRACT

A lighting system. Implementations may include an AC input power source coupled with a power conditioning and control module adapted output a low voltage high frequency pulse width modulated (PWM) signal. A remote transmission cable may be adapted to carry the low voltage high frequency PWM signal to a remote transformer adapted to convert the low voltage high frequency PWM signal to a high voltage high frequency PWM signal. A charge pump may be included which is adapted to receive the high voltage high frequency PWM signal and increase a voltage of the signal. A gas discharge tube may be coupled to the charge pump. A controller may be coupled to the power conditioning and control module and adapted to operate the gas discharge tube at two or more light intensity levels with the low voltage high frequency PWM signal.

3 Claims, 26 Drawing Sheets

(56) References Cited

U.S. PATENT DOCUMENTS

| | | | | |
|---|---|---|---|---|
| 7,242,152 | B2 * | 7/2007 | Dowling et al. | 315/291 |
| 2006/0137512 | A1 * | 6/2006 | Lassar | 84/483.2 |
| 2006/0185502 | A1 | 8/2006 | Nishitani et al. | |
| 2006/0291212 | A1 | 12/2006 | Forsman et al. | |
| 2008/0011149 | A1 | 1/2008 | Eastwood et al. | |
| 2009/0167483 | A1 * | 7/2009 | Jones et al. | 340/3.7 |
| 2009/0266222 | A1 * | 10/2009 | Epstein | 84/483.2 |

OTHER PUBLICATIONS

Samual C. Miller, "Neon techniques and handling", Signs of the Times Pub. Co., 1997. ISBN: 0-911380-41-8.

Marty Brown, "Power Supply Cookbook", Elsevier Science, 2nd Edition, 2001. ISBN: 0-7506-7329-X.

Yuri P. Raizer: translated by Dr. Vitaly I. Kisin, "Gas-Discharge Physics", Springer-Verlag, 1991. ISBN: 0-387-19462-2.

Anders Bondeson, Thomas Rylander and Par Ingelstrom, "Computational Electromagnetics", Springer Science+Busimess Media, 2005. ISBN-10: 0-387-26158-3.

William H. Hyat, Jr. and John A. Buck, "Engineering Electromagnetics", McGraw-Hill Higher Education, 2004. ISBN-13: 978-0072524956.

B. D. Cullity and C. D. Graham, "Introduction to Magnetic Materials", John Wiley and Sons, 2nd Edition, 2009. ISBN: 978-0-471-47741-9.

Edited by: Muhammad H. Rashid, "Power Electronics Handbook", Elsevier Inc., 2nd Edition, 2007. ISBN: 978-0-12-088479-7.

Simon Thompson, "Haskell: The Craft of Functional Programming", Addison-Wesley, 2nd Edition,1999. ISBN: 0-201-34275-8.

Volnei A. Pedroni, "Circuit Design with VHDL", MIT Press, 2004. ISBN: 0-262-16224-5.

Clive "Max" Maxfield, "The Design Warriors Guide to FPGA's", Newnes, 2004. ISBN: 0-7506-7604-3.

Pong P. Chu "RTL Hardware Design Using VHDL", John Wiley and Sons, Inc., 2006. ISBN-10: 0-471-72092-5.

BitC Language compiler http://www.bitc-lang.org/.

Coyotos microkemelhttp://www.coyotos.org/.

* cited by examiner

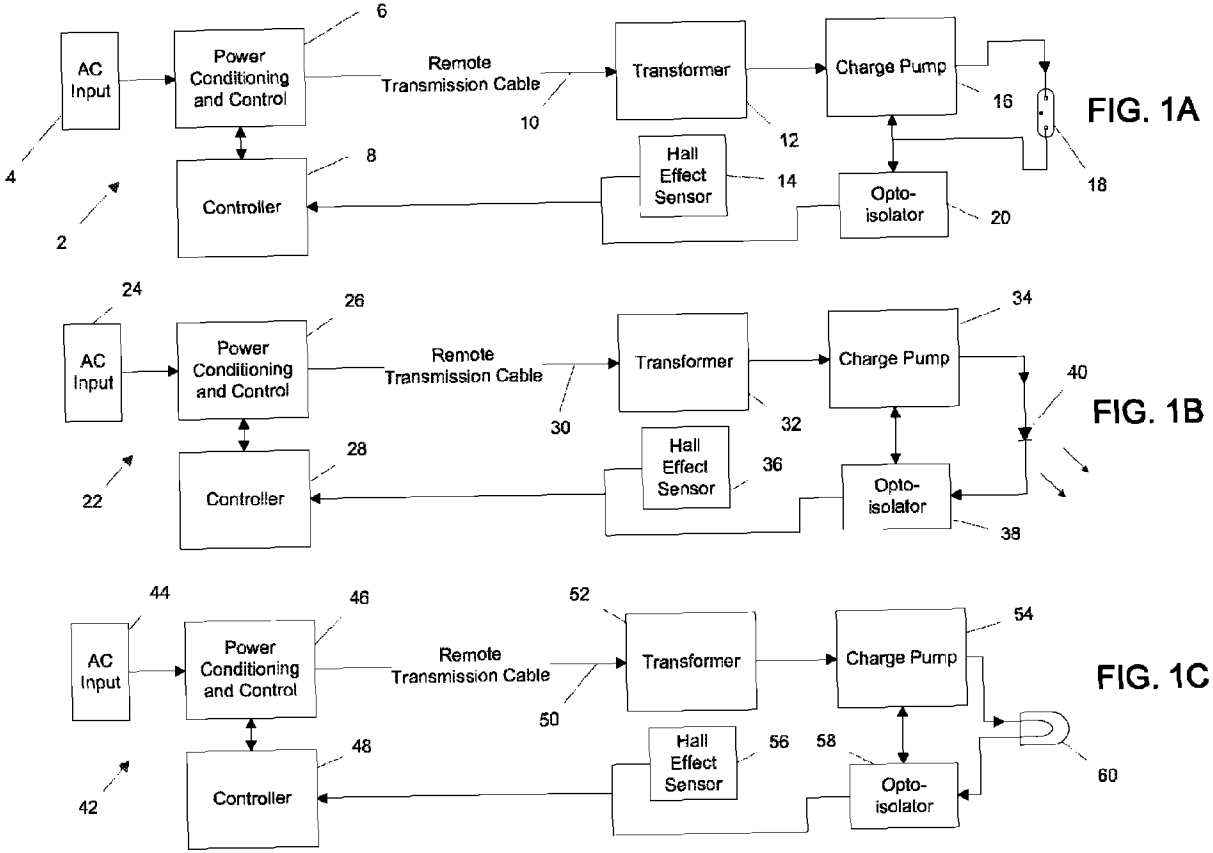
FIG. 1A
AC Input
Power Conditioning and Control
Controller
Remote Transmission Cable
Transformer
Hall Effect Sensor
Charge Pump
Opto-isolator
FIG. 1B
AC Input
Power Conditioning and Control
Controller
Remote Transmission Cable
Transformer
Hall Effect Sensor
Charge Pump
Opto-isolator
FIG. 1C
AC Input
Power Conditioning and Control
Controller
Remote Transmission Cable
Transformer
Hall Effect Sensor
Charge Pump
Opto-isolator

LIGHTING SYSTEMS AND RELATED METHODS

CROSS REFERENCE TO RELATED APPLICATIONS

This document is a Divisional Application to the earlier U.S. patent application Ser. No. 12/837,261, entitled "Lighting Systems and Related Methods" to Bowser, et al., which was filed Jul. 15, 2010, now pending, which claims the benefit of the filing date of U.S. Provisional Patent Application 61/225,689, entitled "Tube Lighting System" to Bowser, et al., which was filed on Jul. 15, 2009; U.S. Provisional Patent Application 61/227,021, entitled "Tube Illumination Methods and Related Systems" to Bowser, et al., which was filed on Jul. 20, 2009; and U.S. Provisional Patent Application 61/229,685, entitled "Lighting Systems and Related Methods" to Bowser, et al., which was filed on Jul. 29, 2009, the disclosures of which are hereby incorporated entirely herein by reference.

This application is also a continuation-in-part application of the earlier U.S. Utility Patent Application to Bowser et al., entitled "Visual Presentation System and Related Methods," application Ser. No. 12/425,214, filed Apr. 16, 2009, now pending, the disclosure of which is hereby incorporated entirely herein by reference.

BACKGROUND

1. Technical Field

Aspects of this document relate generally to lighting systems such as those used to generate light through use of variety of structures and systems, such as, by non-limiting example, arc discharges, electronic transitions, and incandescent illumination.

2. Background Art

Lighting systems contain components and structures that enable the collection, transmission, production and display of light from a variety of energy sources, such as electricity, sunlight, chemical reactions, and others. In lighting systems that employ electricity as an energy source, a wide variety of structures have been devised that use the electrical potential and/or current available to generate light through heating of a filament (incandescent and halogen light bulbs), arc discharge (neon tubes and fluorescent tubes), or through electronic transitions (light emitting diodes (LEDs) and fluorescent tubes). Various colors of light can be emitted through the use of chemical additives to the environment around a filament within a bulb (halogen light bulbs), coatings on the outside surface of the light bulb, additives to gases contained within an arc discharge tube (neon tubes), changes in coatings applied to the interior of an arc discharge tube (neon tubes and fluorescent tubes), or differences in the composition of semiconductor materials contained in a diode (LEDs). Various structures and methods have been devised to ignite and maintain various bulbs and tubes at a desired light level and to control and convey the light to areas where it is useful.

SUMMARY

Implementations of lighting systems like those disclosed in this document may include an alternating current (AC) input power source coupled with a power conditioning and control module where the power conditioning and control module is adapted to receive an AC power signal from the AC input power source and to output a low voltage high frequency pulse width modulated (PWM) signal. A remote transmission cable may be included coupled to the power conditioning and control module and to a remote transformer. The remote transmission cable may be adapted to carry the low voltage high frequency PWM signal and the remote transformer may be adapted to convert the low voltage high frequency PWM signal to a high voltage high frequency PWM signal. A charge pump may be included that includes one or more stages, and the charge pump may be coupled to the remote transformer and may be adapted to receive the high voltage high frequency PWM signal and increase a voltage of the high voltage high frequency PWM signal with the one or more stages. A gas discharge tube may be coupled to the charge pump and a controller may be coupled to the power conditioning and control module. The controller may be adapted to operate the gas discharge tube at two or more light intensity levels with the low voltage high frequency PWM signal produced by the power conditioning and control module.

Implementations of lighting systems like those disclosed in this document may include one, all, or any of the following: A Hall effect sensor may be included, coupled to the controller, and located adjacent to the remote transformer. An opto-isolator may be coupled to the controller and coupled to the charge pump. The gas discharge tube may have a first end and a second end and the remote transformer may be a first remote transformer coupled to the first end. A second remote transformer may be coupled to the second end. The first remote transformer and the second remote transformer may be flyback transformers or single-ended transformers. The remote transmission cable may be a balanced differential transmission cable selected from the group consisting of a coaxial cable, a twinaxial cable, a triaxial cable, or a twisted pair cable. The remote transmission cable may be longer than about 20 feet. The power conditioning and control module may include an electromagnetic interference (EMI)/radio frequency interference (RFI) filter coupled to the AC power source. One or more electronic power supplies (EPS) may also be included. The one or more EPS may include a power factor controller (PFC) coupled to the EMI/RFI filter and an LLC resonant converter coupled to the PFC. One or more electronic power supply (EPS) switchers may be included which include an intensity selection circuit. The one or more EPS switchers may be coupled to each of the one or more EPS and to the remote transmission cable. The controller may include a microprocessor coupled with firmware including one or more duty cycle values and one or more switching frequency values for the one or more EPS switchers corresponding to one or more light intensity levels for the gas discharge tube. A control computer may be included that has a daughter card coupled with the controller. The daughter card may be adapted to convert a control sequence including one or more visual element parameters from the control computer to a data format used by the controller to operate the power conditioning and control module.

Implementations of lighting systems like those disclosed herein may utilize implementations of a method of lighting a gas discharge tube to a desired light intensity. The method may include receiving a DMX512-A, or other hardware protocol channel "on" value and channel intensity value from a control computer, retrieving a duty cycle value and a switching frequency value for an EPS switcher from a location in firmware that corresponds with the hardware protocol channel on value and channel intensity value where the duty cycle value and switching frequency value correspond with a light intensity value for a gas discharge tube indicated by the hardware protocol channel on value. The firmware may be associated with a controller or the EPS switcher. If the gas discharge tube is already ignited, the method may further include operating the EPS switcher at the duty cycle value and switching frequency value, receiving a hardware protocol channel "off" value, and closing the EPS switcher. If the gas discharge tube is not ignited, then the method may include igniting the gas discharge tube by operating the EPS switcher at a predetermined ignition duty cycle and predetermined ignition switching frequency value, operating the EPS switcher at the duty cycle value and switching frequency value, receiving a hardware protocol channel off value, and closing the EPS switcher.

Implementations of a method of lighting a gas discharge tube to a desired light intensity may include one, all, or any of the following: The method may include lighting the gas discharge tube to a flash intensity value by operating the EPS switcher at a flash duty cycle value and a flash switching frequency value adapted to produce excitation of a gas in the gas discharge tube above an operating level of excitation and an ignition level of excitation. Implementations of lighting systems like those disclosed herein may utilize implementations of a method of operating a lighting system. The method may include receiving a first visual element parameter from a control computer and retrieving a duty cycle value and a switching frequency value for an electronic power supply (EPS) switcher from a location in firmware that corresponds with the first visual element parameter where the duty cycle value and switching frequency value may correspond with a desired light intensity value for one or more lighting elements indicated by the first visual element parameter and where the firmware may be associated with a controller or the EPS switcher. The method may also include operating the EPS switcher at the duty cycle and switching frequency, receiving a second visual element parameter, and closing the EPS switcher.

Implementations of a method operating a lighting system may include one, all, or any of the following: The duty cycle value may be a flash duty cycle value and the switching frequency value may be a flash switching frequency value. The flash duty cycle value and the flash switching frequency value may be adapted to produce excitation of the one or more lighting elements above an operating level of excitation. Retrieving the duty cycle value and switching frequency value for the EPS switcher from the location in firmware that corresponds with the first visual element parameter may further include where the duty cycle value and switching frequency value correspond with a desired light intensity value for one or more lighting elements selected from the group consisting of light emitting diodes (LEDs), halogen light bulbs, gas discharge tubes, or fluorescent tubes. Receiving a first visual element parameter and receiving a second visual element parameter may each further include receiving a first visual element parameter and receiving a second visual element parameter formatted in a hardware protocol or timing code reference, such as, by non-limiting example, Musical Instrument Digital Interface (MIDI), DMX512-A, MIDI Timecode (MTC), Ethernet Art-Net, and a Society of Motion Picture and Television Engineers (SMPTE) standard, or other hardware protocol or timing code reference known in the art.

Implementations of lighting systems like those disclosed in this document may utilize a implementations of a method of generating visual element parameters in a control sequence. The method may include providing one or more visual notes on a visual staff and one or more dynamic elements adjacent to the one or more visual notes, associating any of two or more intensity levels for one or more lighting elements included in a lighting system with each of the one or more dynamic elements, and determining which of the one or more visual notes has the shortest time duration. The method may further include multiplying a predetermined number of beats per minute by the shortest time duration and calculating a sending frequency for transmitting lighting element identifying values and lighting element intensity values. The method may include generating a control sequence including one or more visual element parameters using the one or more visual notes and the one or more dynamic elements where the visual element parameters include one or more of the lighting element identifying values and one or more of the lighting element intensity values. The method may also include transmitting the one or more visual element parameters in the control sequence as an output data sequence at the calculated sending frequency to a controller coupled to the lighting system.

Implementations of a method generating visual element parameters in a control sequence may include, one, all, or any of the following: Associating any of two or more intensity levels for one or more lighting elements included in a lighting system may further include associating any of two or more intensity levels for one or more lighting elements selected from the group consisting of LEDS, halogen light bulbs, gas discharge tubes, and fluorescent tubes. Generating a control sequence including one or more visual element parameters may further include generating a control sequence including one or more visual element parameters formatted in a hardware protocol such as, by non-limiting example, MIDI, DMX512-A, MIDI MTC, and an SMPTE standard. Implementations of a lighting systems like those disclosed herein may utilize implementations of a method of detecting and evaluating the operation of a remote transformer. The method may include retrieving a duty cycle value and a switching frequency value for an EPS switcher from firmware, the duty cycle and switching frequency value corresponding with a specified light intensity from a lighting element included in a lighting system. The method may further include operating the EPS switcher at the duty cycle value and switching frequency value and monitoring output from a Hall effect sensor during operation of the EPS switcher. If output is not detected from the Hall effect sensor during operation of the EPS switcher, indicating that the remote transformer is not functioning. If output is detected from the Hall effect sensor, evaluating the output to determine whether the remote transformer is performing as desired.

Implementations of a method of detecting and evaluating the operation of a remote transformer may include one, all, or any of the following: Evaluating the output of the Hall effect sensor to determine whether the remote transformer is performing as desired may further include evaluating using a method selected from the group consisting of differences, comparing median values, least squares fitting, analysis of variance (ANOVA) techniques, variance comparisons, standard deviation comparisons, and statistical control charts. The method may further include monitoring output from an opto-isolator coupled to a charge pump coupled to the remote transformer. If output is not detected from the opto-isolator during operation of the EPS switcher, indicating that one of the remote transformer, the charge pump, or the remote transformer and the charge pump is not working. If output is detected from the opto-isolator during operation of the EPS switcher, evaluating the output to determine whether one of the remote transformer, the charge pump, or the remote transformer and the charge pump is performing as desired. Evaluating the output of the opto-isolator to determine whether one of the remote transformer, the charge pump, or the remote transformer and the charge pump is performing as desired may further include evaluating using a method selected from the group consisting of differencing, comparing median values, least squares fitting, ANOVA techniques, variance comparisons, standard deviation comparisons, and statistical control charts.

Implementations of lighting systems like those disclosed in this document may utilize implementations of a method of calibrating a gas discharge tube included in a lighting system. The method may include loading tube input parameters for initial testing into a controller associated with a lighting system and testing the integrity and ignition of a gas discharge tube included in the lighting system by applying one or more high voltage pulses generated using a power conditioning and control module to the gas discharge tube. The method may also include finding a minimum ignition voltage of the gas discharge tube by applying pulses of incrementally increasing voltage to the gas discharge tube starting at an initial ignition voltage calculated using the tube input parameters. The method may include generating a dimmer voltage calibration curve for an intensity selection circuit by alternately applying a high voltage pulse and a low voltage pulse to the gas discharge tube and recording the dimmer voltage at each high voltage pulse and low voltage pulse applied. The method may also include measuring the light intensity from the gas discharge tube at each applied high voltage pulse and low voltage pulse using a lumen meter, defining two or more steps along the dimmer voltage calibration curve using a microprocessor, and identifying two or more locations along the dimmer voltage calibration curve. The method may include measuring with a lumen meter the light intensity from the gas discharge tube when a voltage pulse that corresponds with each of the two or more locations is applied to the gas discharge tube, determining whether the light intensity at each of the two or more locations is acceptable, and recording a duty cycle value and a switching frequency value used by the power conditioning and control module to create the voltage pulse that corresponds with each of the two or more locations along the dimmer voltage calibration curve. The method may also include creating a template file containing the duty cycle value and switching frequency value corresponding with each of the two or more locations for use by a visual presentation software application.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and:

FIG. 1A is a block diagram of a first implementation of a lighting system;

FIG. 1B is a block diagram of a second implementation of a lighting system;

FIG. 1C is a block diagram of a third implementation of a lighting system;

DESCRIPTION

Figure 2:
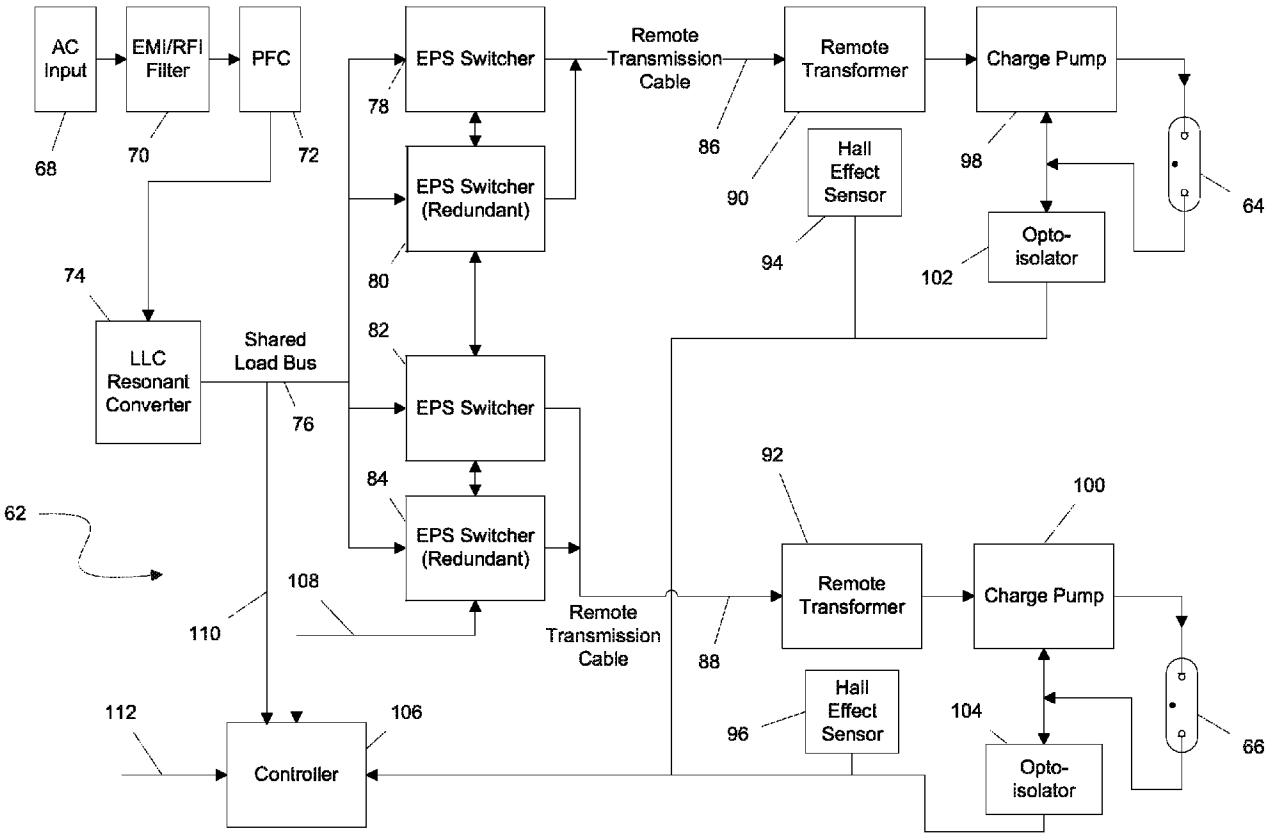
FIG. 2 is a block diagram of a fourth implementation of a lighting system.

This disclosure, its aspects and implementations, is not limited to the specific components or assembly procedures disclosed herein. Many additional components and assembly procedures known in the art consistent with the intended lighting system and/or assembly procedures for a lighting system will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such lighting systems and related methods and implementing components, consistent with the intended operation.

Referring to FIG. 1A, a first implementation of a lighting system 2 is illustrated. In the particular implementation illustrated, the lighting system 2 includes an alternating current (AC) power input 4 coupled to a power conditioning and control module 6 that is controlled by controller 8. The power conditioning and control module 6 receives AC power from the AC power input 4 and creates a low voltage, high frequency, pulse width modulated (PWM) signal which is transmitted across remote transmission cable 10 to remote transformer 12. Hall effect sensor 14 measures magnetic fields generated by remote transformer 12 and provides feedback to controller 8. Remote transformer 12 is adapted to receive the low voltage high frequency PWM signal and to convert it to a high voltage high frequency PWM signal which is received by charge pump 16. Charge pump 16 contains one or more stages that are configured to increase the voltage of the high voltage high frequency PWM signal which is then applied to a gas discharge tube 18 coupled to the charge pump. An opto-isolator 20 may be coupled to the output of the gas discharge tube 18 and to the charge pump 16 and provide voltage level feedback to the controller 8. As used herein, "low voltage" means about 165 V to about 400 V, "high voltage" means any voltage greater than about 400 V, and "high frequency" means frequencies between about 25 kHz to about 500 kHz and above.

After passing through the charge pump 16, the high voltage high frequency PWM signal may be adapted to excite the gases in the gas discharge tube 18 to a particular level of excitation, at which the gases emit light at a particular light intensity. Because in pulse width modulation the amount of power in a pulse and the frequency at which each pulse is applied to a load is configurable, the use of a high voltage high frequency PWM signal with a gas discharge tube may allow for the operation of the tube at two or more levels of gas excitation, or at two or more levels of light intensity.

Referring to FIG. 1B, a second implementation of a lighting system 22 is illustrated. As shown, and similarly to the implementation illustrated in FIG. 1A, the lighting system 22 includes an AC power input 24, power conditioning and control module 26, controller 28, remote transmission cable 30, remote transformer 32, charge pump 34, Hall effect sensor 36, and opto-isolator 38. However, the lighting element included in the lighting system 22 is one or more light emitting diodes (LEDs) 40. Because LEDs rather than gas discharge tubes are used in implementations of the lighting system 22 of FIG. 1B, the structure of the power conditioning and control module 26, the remote transformer 32, and the charge pump 34 may be adapted to supply and control the appropriate voltages, currents, and frequencies that will allow for operation of the LEDs 40 using a signal that is pulse width modulated. For example, if the signal created by the power conditioning and control module 26 is a bus-based midlevel voltage between about 130 V to about 300 V at 40 to 110 kHz, then the remote transformer will be adapted to downconvert the voltage of the signal to the about 3-5 V level needed to operate the LEDs 40. The charge pump 34 may also be adapted not to run one LED but power an array of LEDs. In implementations of lighting systems 22, instead of focusing on providing a particular run voltage to the LEDs 40, the design of the power conditioning and control module 26, the remote transformer 32, and the charge pump 34 may be to ensure that a steady-state run load current is provided to the LEDs 40 to enable them to run at a desired intensity level.

Referring to FIG. 1C, a third implementation of a lighting system 42 is illustrated. As illustrated, and similarly to the two previous implementations of lighting systems 2, 22 discussed, the lighting system 42 includes an AC power input 44, power conditioning and control module 46, controller 48, remote transmission cable 50, remote transformer 52, charge pump 54, Hall effect sensor 56, and opto-isolator 58. The lighting element included in the system includes one or more halogen light bulbs 60. Like the implementation of a lighting system 22 previously discussed, the power conditioning and control module 46, remote transformer 52, and charge pump 54 may all be configured to operate at voltage and current levels sufficient to run the one or more halogen light bulbs 60. For example, in particular implementations, the remote transformer 52 may be adapted to downconvert a bus-based midlevel voltage between about 130 V to about 300 V at 40 at 110 kHz to a voltage of about 12 to about 100 V which may be needed to operate an array of halogen bulbs. Because the signal used to operate the halogen bulbs is pulse width modulated, the bulbs may be operated at different desired light intensities. In particular implementations, the power conditioning and control module 46, remote transformer 52, and charge pump 54 may be configured to ensure that a steady-state run load current is provided to one or more halogen bulbs 60 during operation.

Referring to FIG. 2, a block diagram of a fourth implementation of a lighting system 62 is illustrated. The lighting system 62 shown is configured to operate two or more gas discharge tubes 64, 66. The lighting system 62 includes an AC power input 68 coupled to an electromagnetic interference/radio frequency interference (EMI/RFI) filter 70. An example of an EMI/RFI filter can be found as element 236 in FIG. 14 and relevant teachings regarding the structure and use of such filters may be found in Appendix A to U.S. Provisional Patent Application 61/227,021, entitled "Tube Illumination Methods and Related Systems" to Bowser, et al., which was filed on Jul. 20, 2009 (the '021 provisional) which was previously incorporated by reference. The lighting system 62 also includes a power factor controller (PFC) 72 coupled to an LLC resonant converter 74 which provides a direct current (DC) signal to shared load bus 76. The DC signal from the LLC resonant converter 74 is provided via the shared load bus 76 to electronic power supply (EPS) switchers 78, 80, 82, and 84. Two of the EPS switchers 78, 82 may be primary, while the other two EPS switchers 80, 84 may be redundant units that are used when the primary EPS switcher 78, 82 fail to operate, and may be activated under direction of the controller 106. The output of the EPS switchers 78, 80, 82, 84 is a low voltage, high frequency pulse width modulated (PWM) signal. Collectively, the EMI/RFI filter 70, PFC 72, LLC resonant converter 74, shared load bus 76, and EPS switchers 78, 80, 82, 84 may constitute components of an implementation of a power conditioning and control module like those in the lighting system implementations previously discussed.

Figure 11:
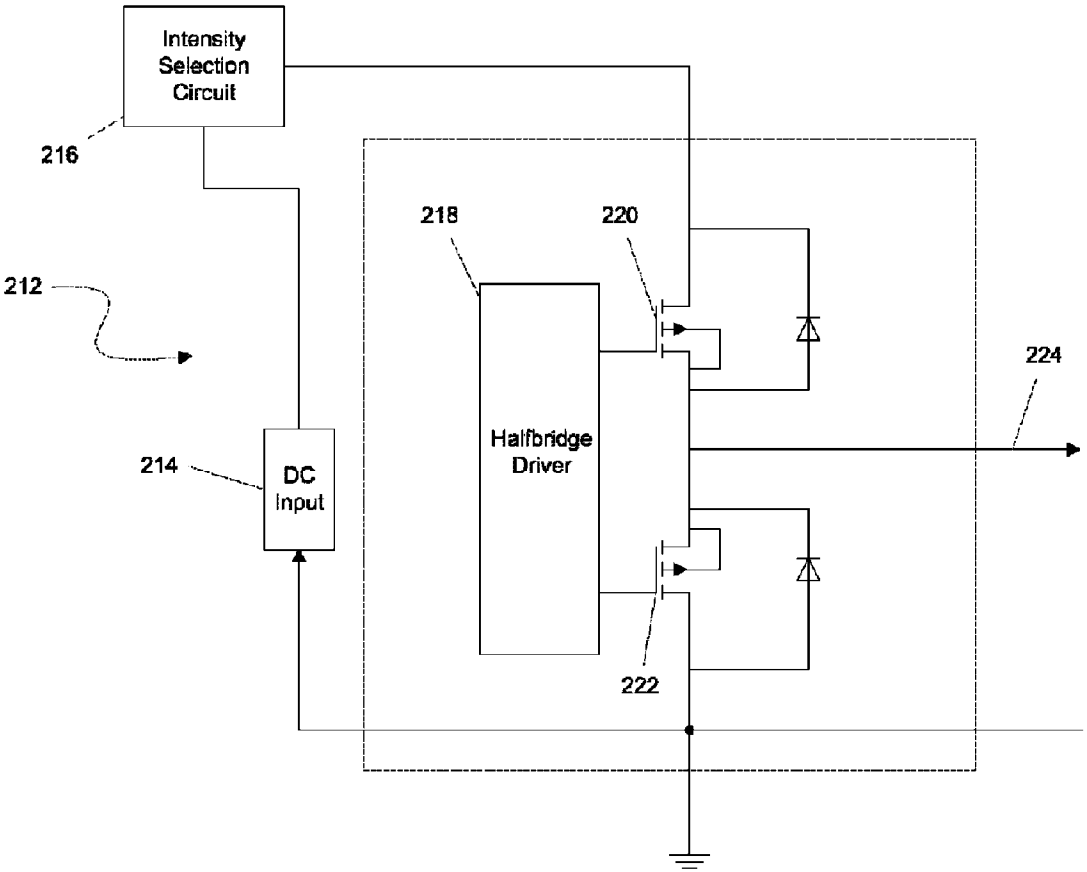
FIG. 11 is an electrical schematic of an implementation of the components of an electronic power supply (EPS) switcher implementation.
Figure 12:
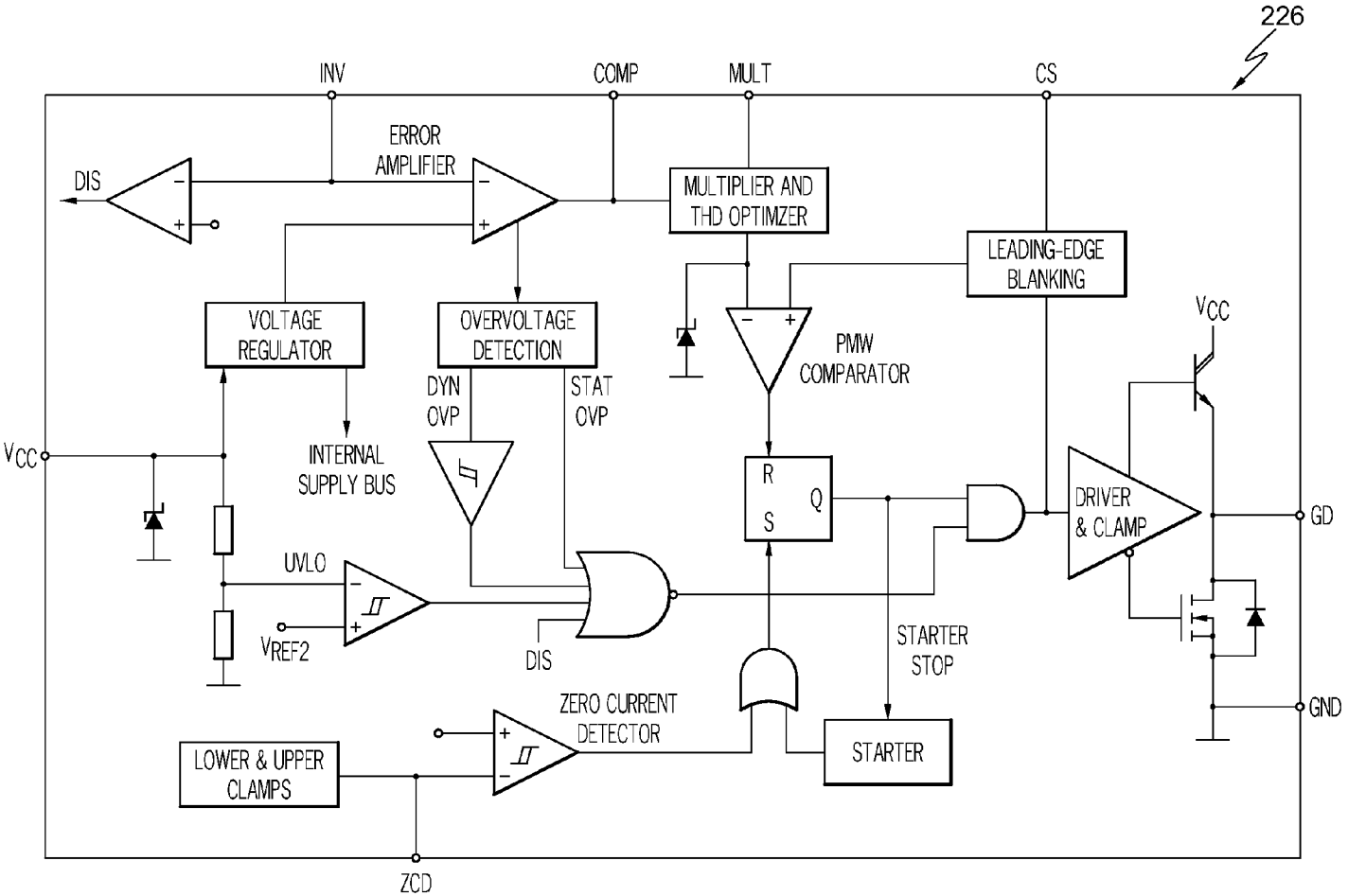
FIG. 12 is an electrical schematic of an implementation of a power factor controller (PFC)

An example of the structure of a PFC 72 that could be used in implementations of lighting systems 62 can be found as 226 in FIG. 12. An example of the structure of an LLC resonant converter 74 that could be used in various implementations of lighting systems 62 may be found as 228 in FIG. 13. An example of the structure of an EPS switcher 78, 80, 82, 84 that may be utilized in various implementations of lighting systems 62 may be found as 212 in FIG. 11. The EMI/RFI filter 70, PFC 72, and LLC resonant converter 74 may collectively be referred to as an electronic power supply (EPS) or as a switched mode power supply (SMPS). Additional disclosure regarding the structure and use of EMI/RFI filters, PFCs, LLC resonant converters, shared load buses, and EPS switchers may be found in the '021 provisional, U.S. Provisional Patent Application 61/225,689, entitled "Tube Lighting System" to Bowser, et al., which was filed on Jul. 15, 2009 (the '689 provisional), and the U.S. Provisional Patent Application 61/229,685, entitled "Lighting Systems and Related Methods" to Bowser, et al., which was filed on Jul. 29, 2009 (the '685 provisional) the disclosures of which were previously incorporated herein by reference.

The low voltage high frequency PWM signal is sent across remote transmission cables 86, 88 to remote transformers 90, 92. Remote transformers 90, 92 may be located away from, or remotely from, the AC power input 68 and related equipment, being connected via the remote transmission cable 86, 88. Conventional gas discharge tubes are generally connected to the power sources providing the voltage to run them via a neon gas tube and oil burner ignition (GTO) cable which includes a single conductor that may or may not be shielded. Since in conventional gas discharge tube systems high voltages and high frequencies are used to light the tubes, the single conductor in the GTO cable acts increasingly as a capacitor as the GTO cable increases in length (and as the frequency applied increases). At a certain cable length, the power capable of being transmitted via a GTO cable decreases to the point that it cannot be used to run a conventional gas discharge tube. This length has been found to be approximately 20 feet.

Implementations of remote transmission cables 86, 88 may be balanced differential transmission cables which may, in particular implementations, take the form of a twisted pair cable. Any of a wide variety of twisted pair cables may be employed, including, by non-limiting example, coaxial cable, twinaxial cable, triaxial cable, and any other number of twisted pair or paired cable types. In implementations of remote transmission cables 86, 88 that utilize twisted pair cables, the number of turns along the length of the cable creates a customizable impedance characteristic and allows for the use of specially designed cables in particular implementations. By using remote transformers 90, 92 located close to the gas discharge tubes 64, 66, high voltage cables like GTO cables do not need to be used for the remote transmission. Accordingly, the distance between the AC power input 68 and related power conditioning and control components can be greater than about 20 feet and may extend to 250 feet or more. A number of other installation and operational advantages may result from this arrangement which are described in the '689 provisional application.

In order to monitor the operation of and test the performance of the remote transformers 90, 92, Hall effect sensors 94, 96 are located adjacent to the remote transformers 90, 92. The remote transformers are adapted to receive the low voltage high frequency PWM signal and to convert it to a high voltage high frequency PWM signal which is then passed to charge pumps 98, 100. In particular implementations, and, as illustrated in FIG. 2, opto-isolators 102, 104 may be coupled to the charge pumps 98, 100 and the output of the gas discharge tubes 64, 66 and may be used to monitor and/or evaluate the performance of the remote transformers 90, 92, the charge pumps 98, 100, or both. The Hall effect sensors 94, 96 and the opto-isolators 102, 104 are coupled with the controller 106 which uses the feedback from the sensors to send controller output signals 108 (which may include duty cycle values and switching frequency values) to the primary EPS switchers 78, 82. A tap 110 from the shared load bus 76 may also be used by the controller 106 to monitor the power levels available to the EPS switchers 78, 80, 82, 84. The controller 106 also receives control data, which may include control sequence data, through data input 112.

The various structures and uses of implementations of components of a lighting system implementation 62 like the one illustrated in block diagram form in FIG. 2 will be discussed in the following paragraphs. While these implementations are discussed in the context of the implementation illustrated in FIG. 2, they may also be applied and used in any other implementation of a lighting system disclosed in this document and in the other applications previously incorporated by reference.

Figure 3:
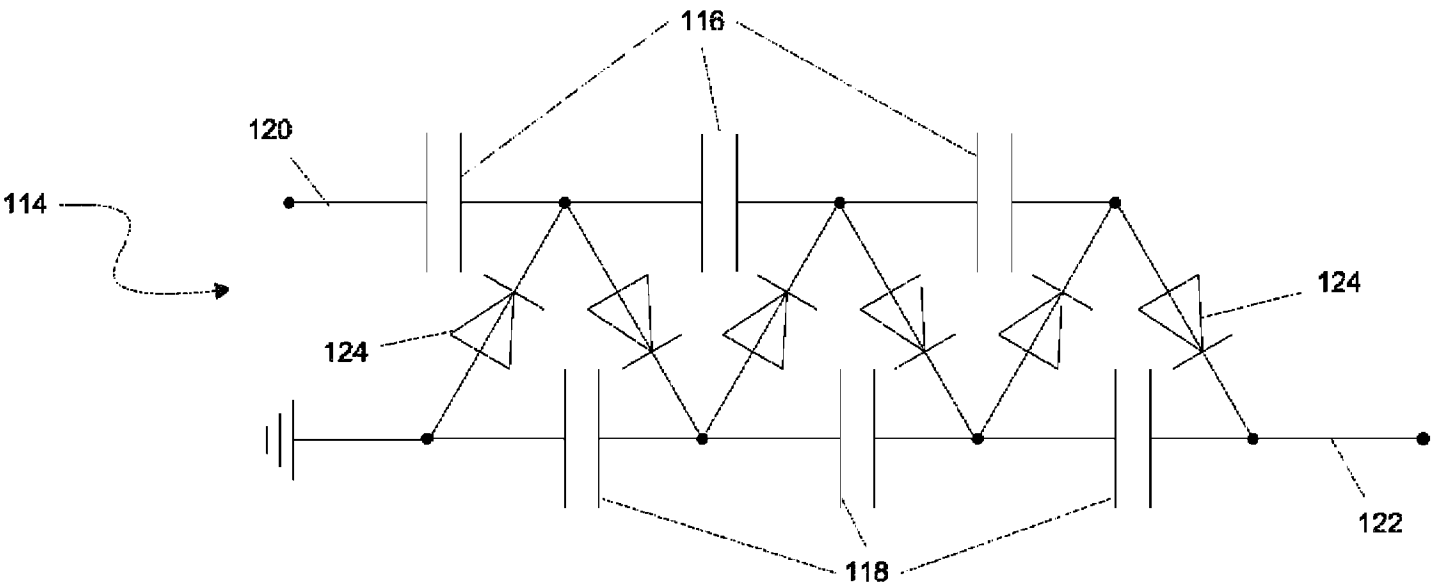
FIG. 3 is an electrical schematic of a Cockcroft-Walton charge pump with three stages.
Figure 4:
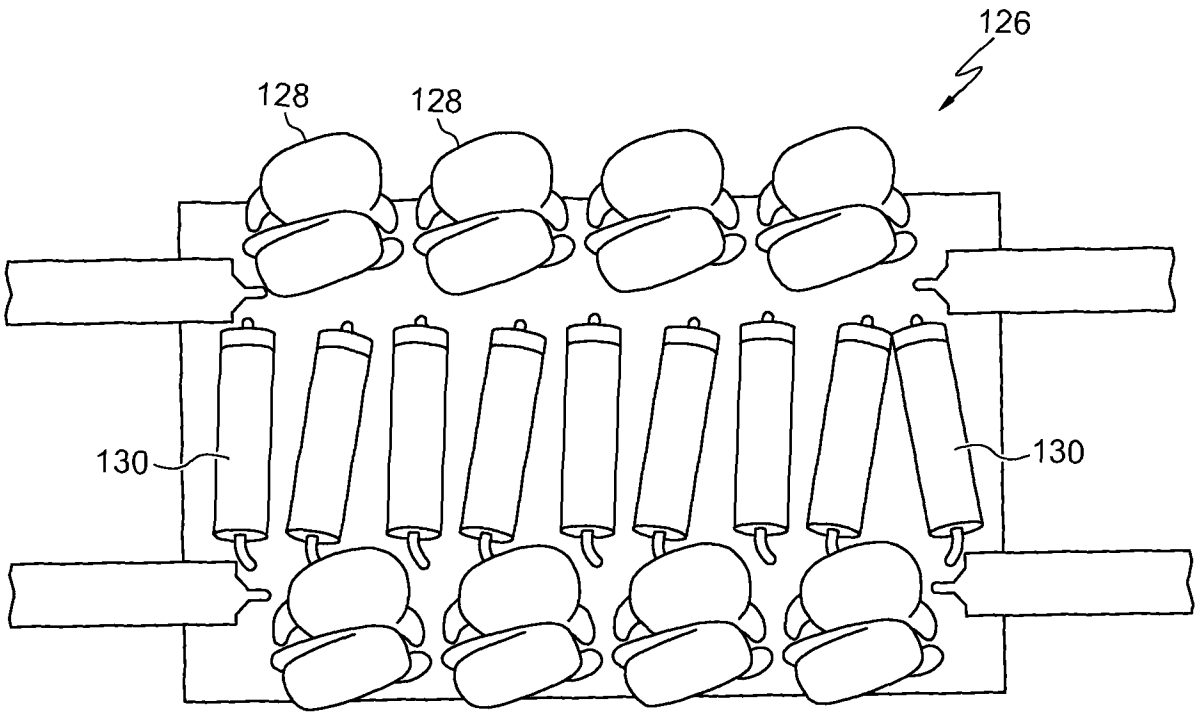
FIG. 4 is a top view of an implementation of a Cockcroft-Walton charge pump with four stages.

Referring to FIG. 3, an electrical schematic of an implementation of a charge pump 114 is illustrated. The implementation illustrated is a Cockcroft-Walton charge pump with three stages, which is sometimes referred to as a tripler. The charge pump has three stages which are indicated by the location of the capacitors 116 at the upper portion of the charge pump 114 or the capacitors 118 at the lower portion of the charge pump 114. The charge pump 114 includes an input 120 and an output 122 and voltage potential of a signal is increased as it passes through the combination of capacitors and diodes 124 that form the various stages. Charge pump implementations used in various implementations of lighting systems may include one or more stages. Referring to FIG. 4, a top view of a charge pump implementation 126 is illustrated that includes 4 stages of capacitors 128 and diodes 130. While in the implementations illustrated in FIGS. 3 and 4, the capacitors 128 and diodes 130 included in the charge pump 126 are all the same, in some implementations, capacitors and diodes of different ratings may be employed to produce a desired effect. For the exemplary purposes of this disclosure, in the particular implementations illustrated in FIGS. 3 and 4, the capacitors 116, 118, 128 employed in the charge pumps 114, 126 illustrated are 0.001 μF 15 kV ceramic capacitors manufactured by Vishay Corporation of Malvern, Pa. and marketed under the trademark Cera-Mite® and the diodes 124, 130 are 10 kV 100 mA 100 nsec high voltage diodes distributed by Allied Electronics of Forth Worth, Tex.

Figure 5B:
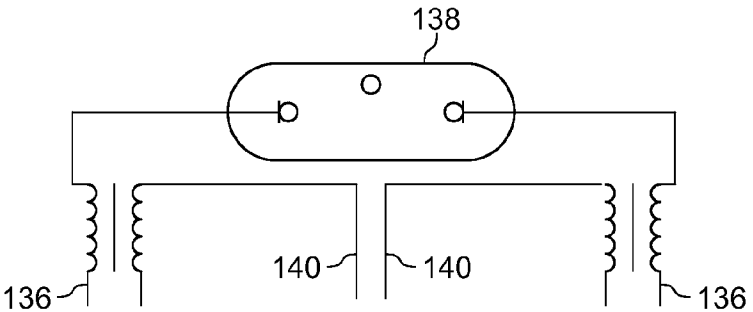
FIG. 5B is an electrical schematic of a gas discharge tube with two flyback transformers.
Figure 5A:
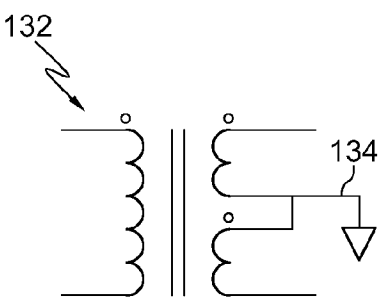
FIG. 5A is an electrical schematic of a transformer with a center tap.
Figure 5C:
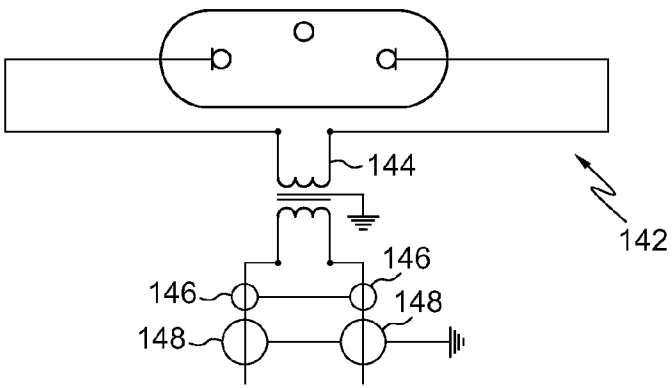
FIG. 5C is an electrical schematic of a gas discharge tube with a single-ended transformer and faraday shields.

A wide variety of transformer types and designs may be employed in various implementations of remote transformers used in the implementations of lighting systems disclosed in this document. Referring to FIG. 5A, an electrical schematic of a transformer 132 with a center tap 134 is illustrated. Transformers 132 may be employed in various implementations of remote transformers depending upon the particular design of the remote transformer/charge pump combination. In particular implementations, no center tap 134 may be used, and in others, more than one tap may be present. FIG. 5B illustrates a pair of remote transformers 136 coupled to each end of a gas discharge tube 138 (the charge pumps are omitted from this drawing). In this configuration, the remote transformers 136 can be referred to as flyback transformers and are used to help operate a gas discharge tube 138 that is particularly long. As illustrated, one side of the windings 140 on each of the flyback transformers 136 is coupled to the controller. Referring to FIG. 5C, an implementation of a single-ended transformer/gas discharge tube combination 142 is illustrated. As illustrated, a single single-ended transformer 144 is used to convert the low voltage high frequency PWM signal to a high voltage high frequency PWM signal. As shown, the inner shields 146 are connected to neutral while the outer shields 148 are connected to ground which creates a balanced configuration. As in the previous figure, the charge pumps have been omitted from this schematic.

Figure 5D:
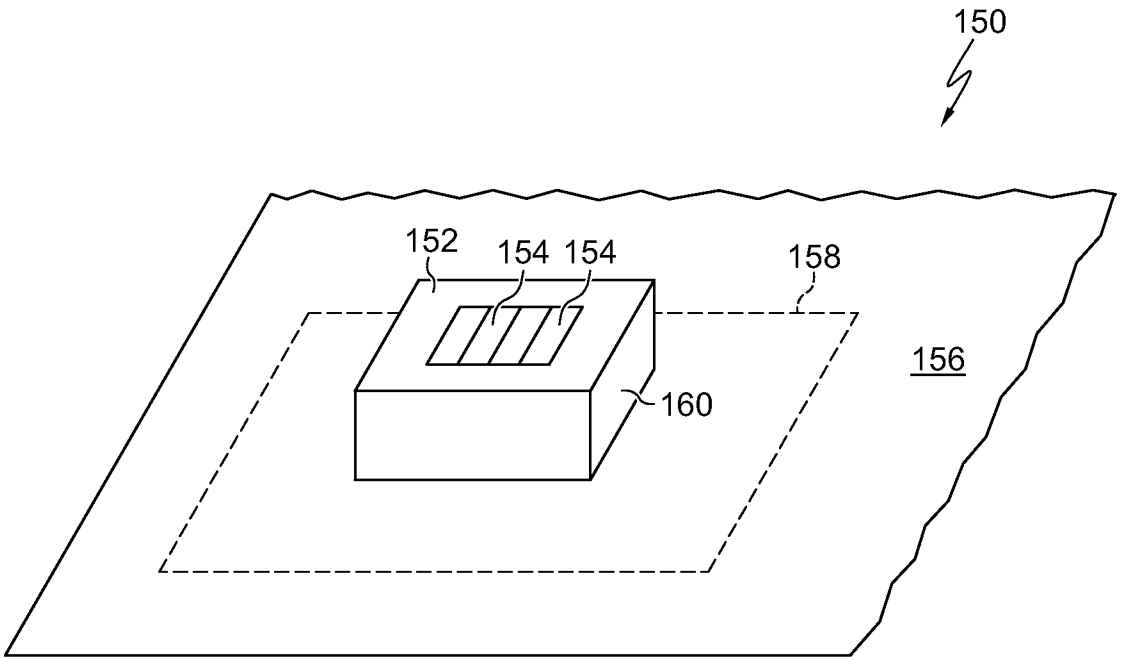
FIG. 5D is a perspective diagram of a transformer coupled over a circuit board containing an iso-ground plane.
Figure 6B:
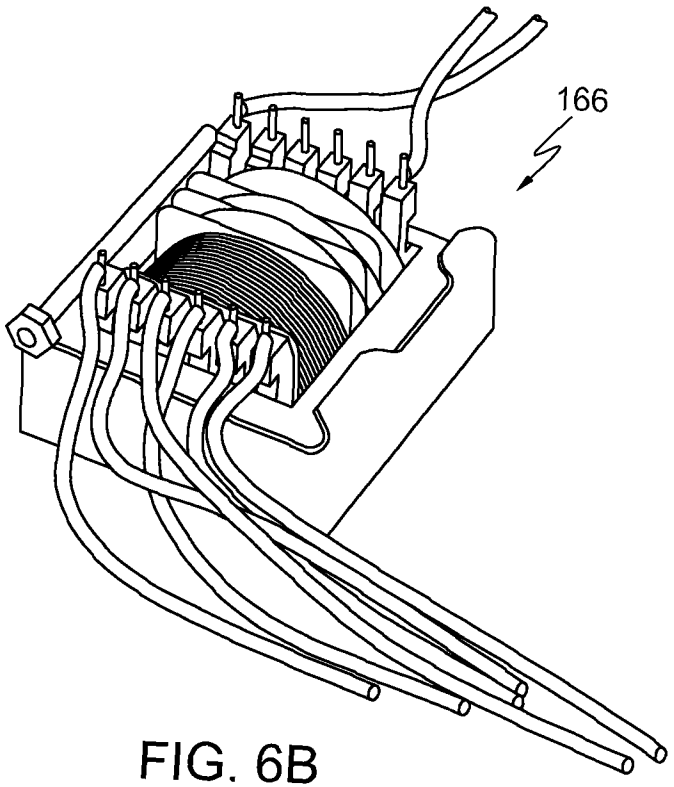
FIG. 6B is a perspective view of an E core transformer.
Figure 6A:
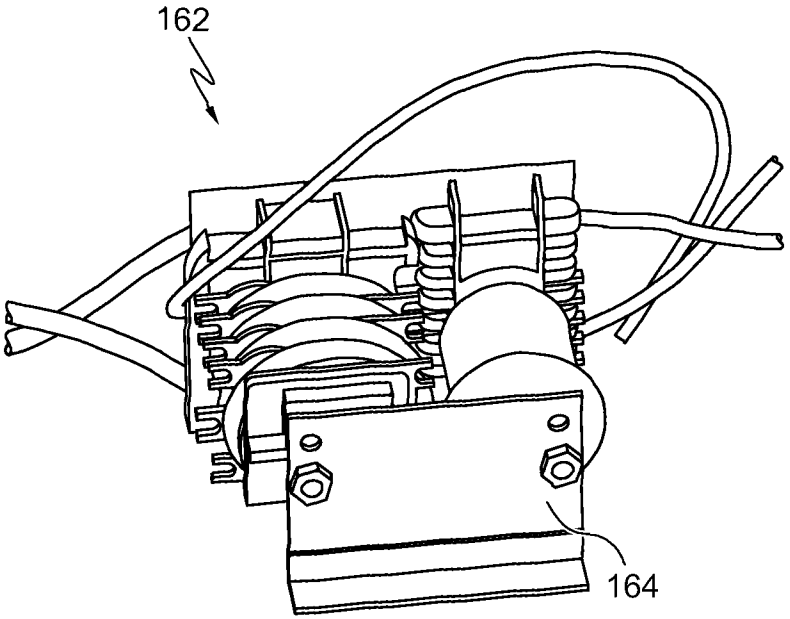
FIG. 6A is a perspective view of a U core transformer.

Referring to FIG. 5D, a schematic of an implementation of a remote transformer assembly 150 is illustrated. As illustrated, the remote transformer assembly 150 includes a remote transformer 152 that includes a bobbin with windings 154 that is coupled to a circuit board 156. An iso-ground plane 158 is included in the circuit board 156. Because the remote transformer 152 is coupled to a circuit board, a Hall effect sensor (not shown) can be coupled beneath the remote transformer 152 on the circuit board to be in position to detect the magnetic fields created as the remote transformer 152 is operating. A copper plate 160 is incorporated in the remote transformer 152 and is used to measure the potential difference between the iso-ground plane 158 and a ferrite core within the bobbin with windings 154 of the remote transformer 152. FIG. 6A illustrates a remote transformer 162 configured to be coupled to a circuit board like the remote transformer 142 in FIG. 5D. Copper plate 164 is shown coupled at one end.

A wide variety of transformer physical configurations may be employed in implementations of remote transformers used in implementations of lighting systems disclosed in this document. FIG. 6A illustrates a remote transformer 162 that is a U core transformer. FIG. 6B illustrates E core transformer 166. Additional transformer configurations may be employed including planar core transformers.

Figure 7:
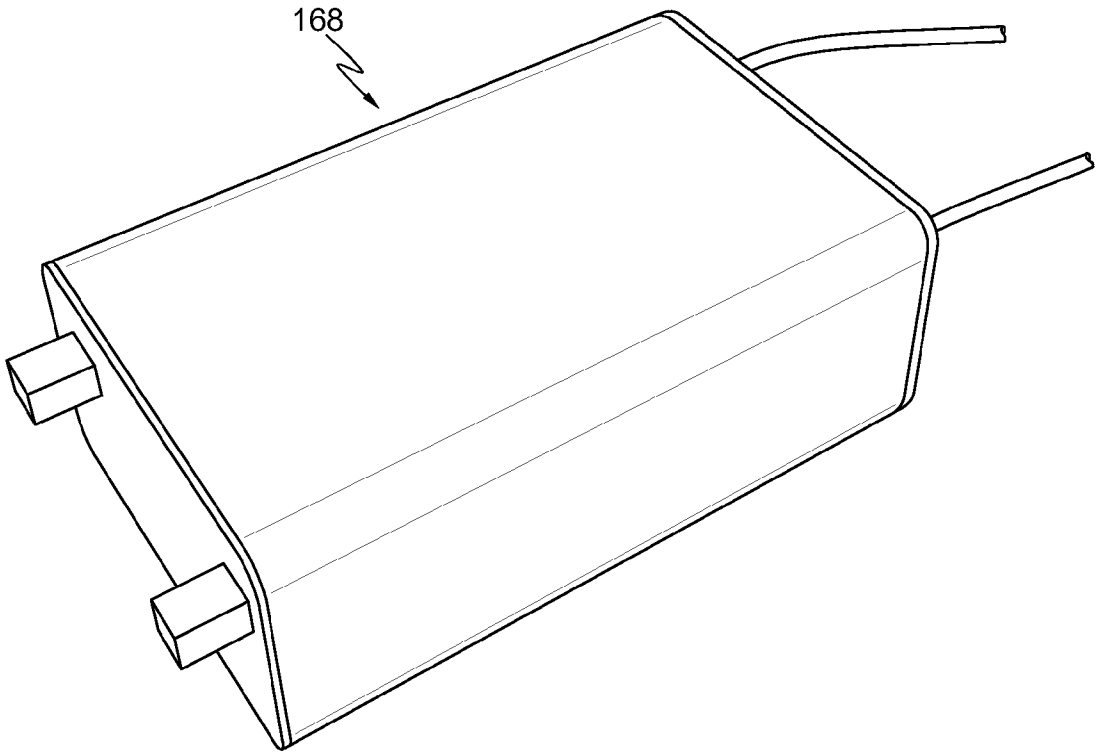
FIG. 7 is a perspective view of a implementation of a charge pump and remote transformer included in a single enclosure.

Referring to FIG. 7, implementations of remote transformers and charge pumps may be included in a single housing like the enclosure 168 illustrated. Because the rest of the power conditioning and control components do not need to be immediately adjacent to the gas discharge tubes when remote transformers and remote transmission cables are utilized, the remote transformers and charge pumps can be located within the housing that encloses the gas discharge tubes. An example of how such an enclosure 168 can be located adjacent to gas discharge tubes can be seen in FIG. 11 in the '689 application, which is a detail view of a light display in an enclosure like the one illustrated in FIG. 10 of the same application. A wide variety of enclosure shapes, configurations, and designs are possible using the principles disclosed in this document.

Figure 8:
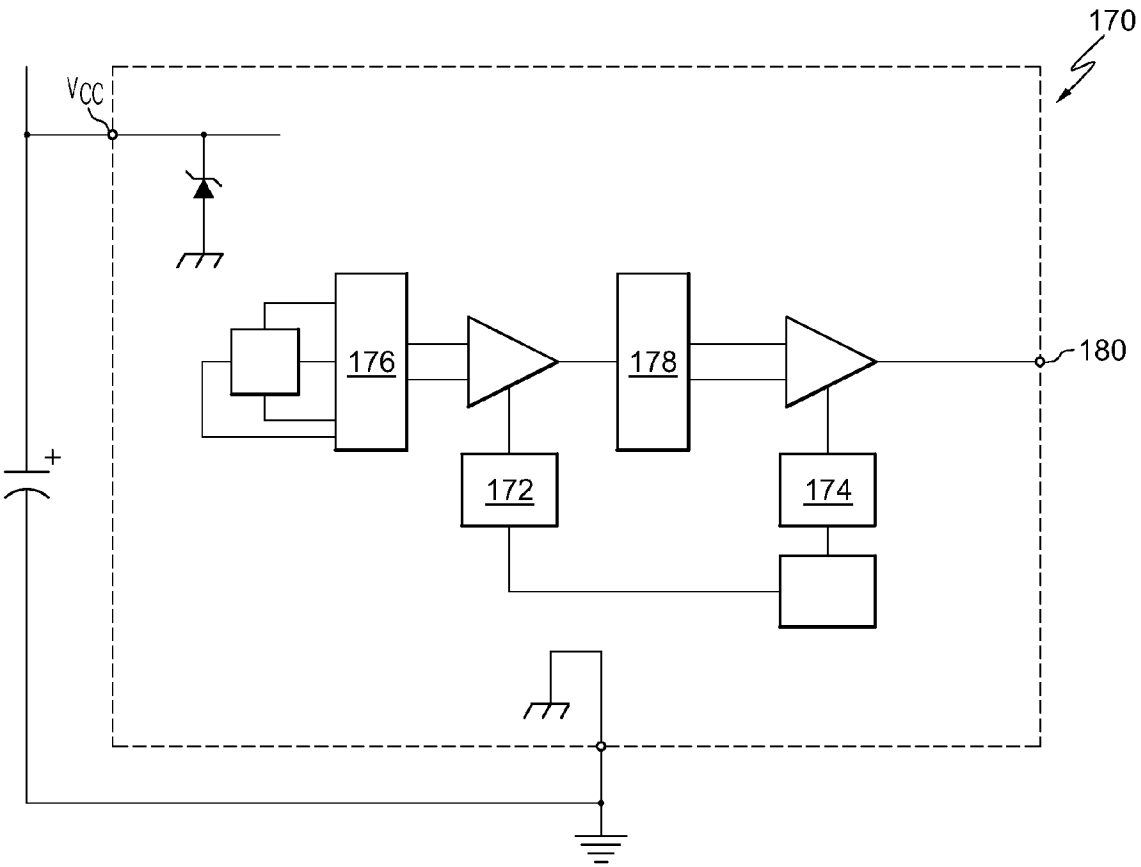
FIG. 8 is an electrical schematic of an implementation of a Hall effect sensor.

Implementations of remote transformers like those disclosed herein may be monitored by various Hall sensor implementations. Referring to FIG. 8, an electrical schematic of an example of a Hall sensor implementation 170 is illustrated for the exemplary purposes of this disclosure. Any of a wide variety of Hall sensor implementations may also be employed. As illustrated, the Hall sensor 170 alters an input voltage potential VCC with a voltage induced by a magnetic field which is adjusted by various gain 172, offset 174, dynamic offset 176, and filter 178 components to produce an output voltage 180 modulated by the sensed magnetic field. As a result, the output voltage 180 of the Hall sensor can be used by the controller as a measurement of the strength of the magnetic field produced by a remote transformer. For the exemplary purposes of this disclosure, the Hall sensor illustrated by the electrical schematic in FIG. 8 is an A1321 ratiometric linear Hall effect sensor manufactured by Allego MicroSystems, Inc. of Worchester, Mass. While the Hall sensor illustrated is a linear sensor, other Hall effect sensor types may be utilized in particular implementations.

Figure 9:
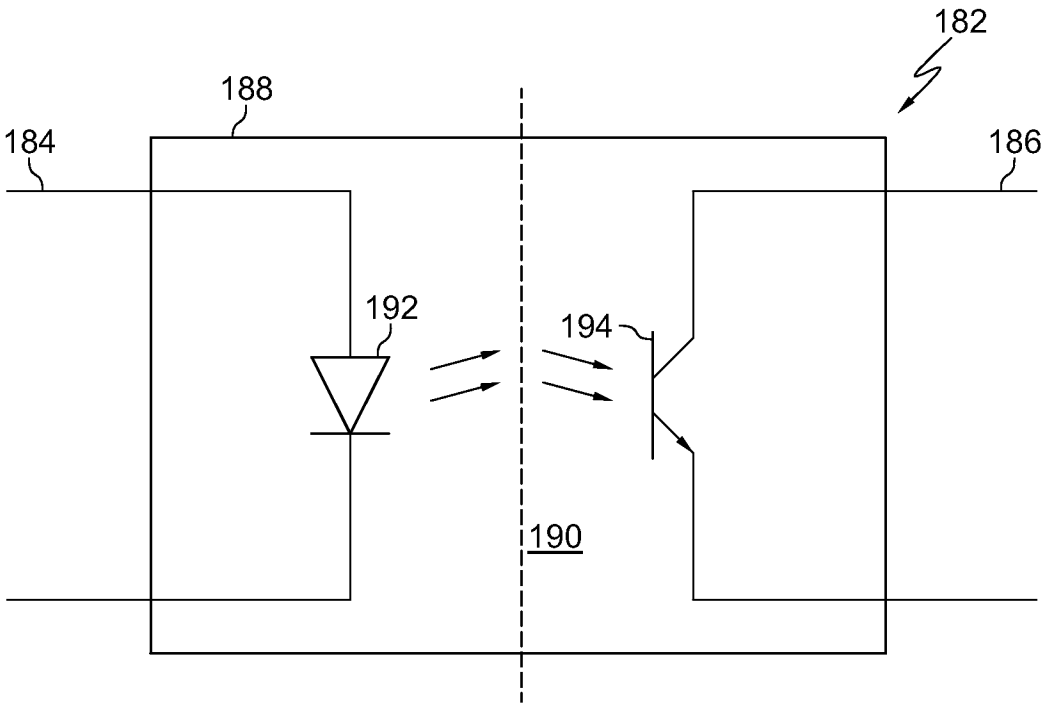
FIG. 9 is an electrical schematic of an implementation of an opto-isolator.

Referring to FIG. 9, a schematic of an implementation of an opto-isolator 182 is illustrated. As illustrated, the opto-isolator has two electrically independent circuits 184, 186 that are enclosed in housing 188. The housing 188 is designed to prevent any light from entering the area between the two circuits 190. Circuit 184 includes an LED 192 which is configured to light at a particular applied voltage. Circuit 186 includes a photodetector 194 designed to open (or close) the circuit 186 when light is received from the LED 192 through the area between the two circuits 190. Because there is no electrical connection between the two circuits 184, 186, the voltages at which the two circuits 184, 186 operate can vary widely while allowing communication between them.

Implementations of opto-isolators used in conjunction with charge pump implementations like those disclosed in this document may be useful in situations where the charge pump is configured to raise the voltage of the received high voltage high frequency PWM signal to significantly higher levels in order to ignite a gas discharge tube that is long. In these situations, attempting to directly measure the actual potential of the high voltage high frequency PWM signal would be difficult and expensive. Using an opto-isolator, however, the ability to detect whether the high voltage high frequency PWM signal has reached a certain threshold voltage can be detected simply by observing when the LED 192 lights and photodetector 194 responds. Because of this property of opto-isolators, various implementations of the system may use opto-isolators to monitor the operation and evaluate the performance of the remote transformer, the charge pump, or both the remote transformer and the charge pump. However, not all implementations of lighting systems disclosed in this document may utilize opto-isolators but may rely on the Hall effect sensors to monitor the operation of the remote transformer/charge pump combination.

Figure 10:
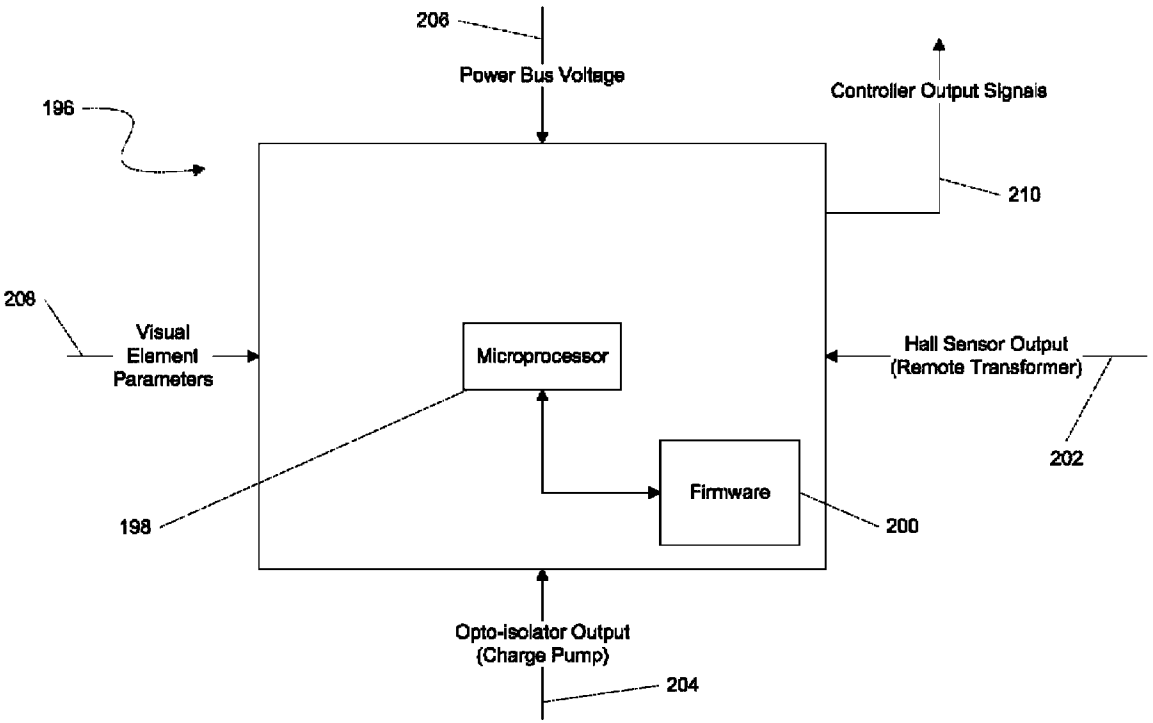
FIG. 10 is a block diagram of an implementation of a controller for a light system implementation.

Referring to FIG. 10, a block diagram of a controller 196 is illustrated. The controller 196 includes a microprocessor 198 that is in communication with firmware 200. In particular implementations of lighting systems the firmware 200 is associated with or part of the controller 196; in others, the firmware 200 may be associated with or part of the EPS switchers themselves. The firmware may be an field programmable gate array (FPGA), a Flash memory chip, a random access memory (RAM) chip, an electrically erasable programmable read-only memory (EEPROM), or any other data storage device, such as a hard drive. A look-up table or other data retrieval method or system may be associated with or incorporated into the firmware which contains the locations of various duty cycle values and switching frequency values and their correspondence with various light intensity levels for each lighting element included in a lighting system implementation. Various timing information may also be included, particularly in implementations where gas discharge tubes are utilized as lighting elements.

The controller 196 receives Hall sensor output from the operation of the remote transformer at Hall sensor input 202. In implementations of lighting systems utilizing opto-isolators, the controller 196 may receive output from the opto-isolators at the opto-isolator sensor input 204. Controller 196 also receives reference power bus voltage information at power bus voltage input 206 which is used, along with information contained in visual element parameters contained in control stream 208, to generate output signals carried to the EPS switchers and other components via controller output 210. The controller 196 may, in particular implementations, utilize various pulse shape generates based on a "V-I P" transfer function and may be adapted to generate pulses for frequencies from about 25 kHz to about 500 kHz and above. The controller 196 may be adapted to receive visual element parameters in a variety of formats, including, by non-limiting example, Musical Instrument Digital Interface (MIDI), DMX512-A, MIDI Timecode (MTC), and a Society of Motion Picture and Television Engineers (SMPTE) standard. The information included in the visual element parameters could include, by non-limiting example, DMX512-A channel or other hardware protocol channel "on" values, DMX512-A channel or other hardware protocol channel "off" values, DMX512-A channel or other hardware protocol channel intensity values, lighting element identifying values, lighting element intensity values, MIDI note on values, MIDI note off values, and any other lighting element identifying and lighting element intensity identifying parameters. The controller 196 may be adapted to be able to control any one or any combination of gas discharge tubes, halogen light bulbs, fluorescent bulbs, or LEDs, depending upon the configuration of a particular lighting display.

Referring to FIG. 11, an implementation of an EPS switcher 212 is illustrated. As illustrated, the EPS switcher 212 receives a direct current (DC) input signal from DC input 214 which may pass through an intensity selection circuit 216. The intensity selection circuit may, in particular implementations, under the direction of the controller, determine the duty cycle and switching frequency for the switches included in the EPS switcher 212. In other implementations, no intensity selection circuit 216 may be employed and the duty cycle and switching frequency may be supplied directly by the controller. A halfbridge driver 218 is used to aid in the operation of the two switches 220, 222, which, in the implementation illustrated in FIG. 11, are metal oxide semiconductor field effect transistors (MOSFETs). In particular implementations, the switches 220, 222 may be insulated gate bipolar transistors (IGBTs). As illustrated in FIG. 3, a redundant set of switches may be provided in case of failure of a primary set; the logic controlling when to switch to the redundant set is carried out by the controller.

The switches 220, 222 can apply power to the remote transformers through creating a low voltage, high frequency PWM signal. Since the switches 220, 222 control the application of DC power to the EPS switcher output 224, they create an alternating current signal that sends energy in pulses at specific voltages. The duty cycle of the low voltage high frequency signal created is the amount of time that power is applied to the remote transformers per switching period. Since pulse width modulation is utilized, the switching frequency is the frequency of the square wave utilized to establish the particular duty cycle. The switching frequency is sent either from the controller or the intensity selection circuit 216. When the switching frequency values increase, the amount of power actually transferred in the remote transformer in a particular period of time will decrease. Additional relevant teachings regarding the algorithms, methods, and EPS switcher implementations may be found in Barhoover et al., "Three Phase 500 W Inverter As An Induction Motor Drive," University of Illinois, ECE 345 Design Project (Spring 2003) included with the '021 application as Appendix C.

Referring to FIG. 12, an electrical schematic of an implementation of a PFC 226 is illustrated. While in the block diagram in FIG. 2 the PFC 72 is illustrated in a separate block, various implementations of lighting system may include the PFC 226 as part of the LLC resonant converter or an LLC resonant converter/intensity selection circuit combination. The PFC 226 illustrated in FIG. 12 is an L6562A manufactured by STMicroelectronics, Inc. of Geneva, Switzerland. Any of a wide variety of PFC types may be employed depending upon the characteristics of the AC input power source and the needed DC output to the EPS switchers.

Figure 13:
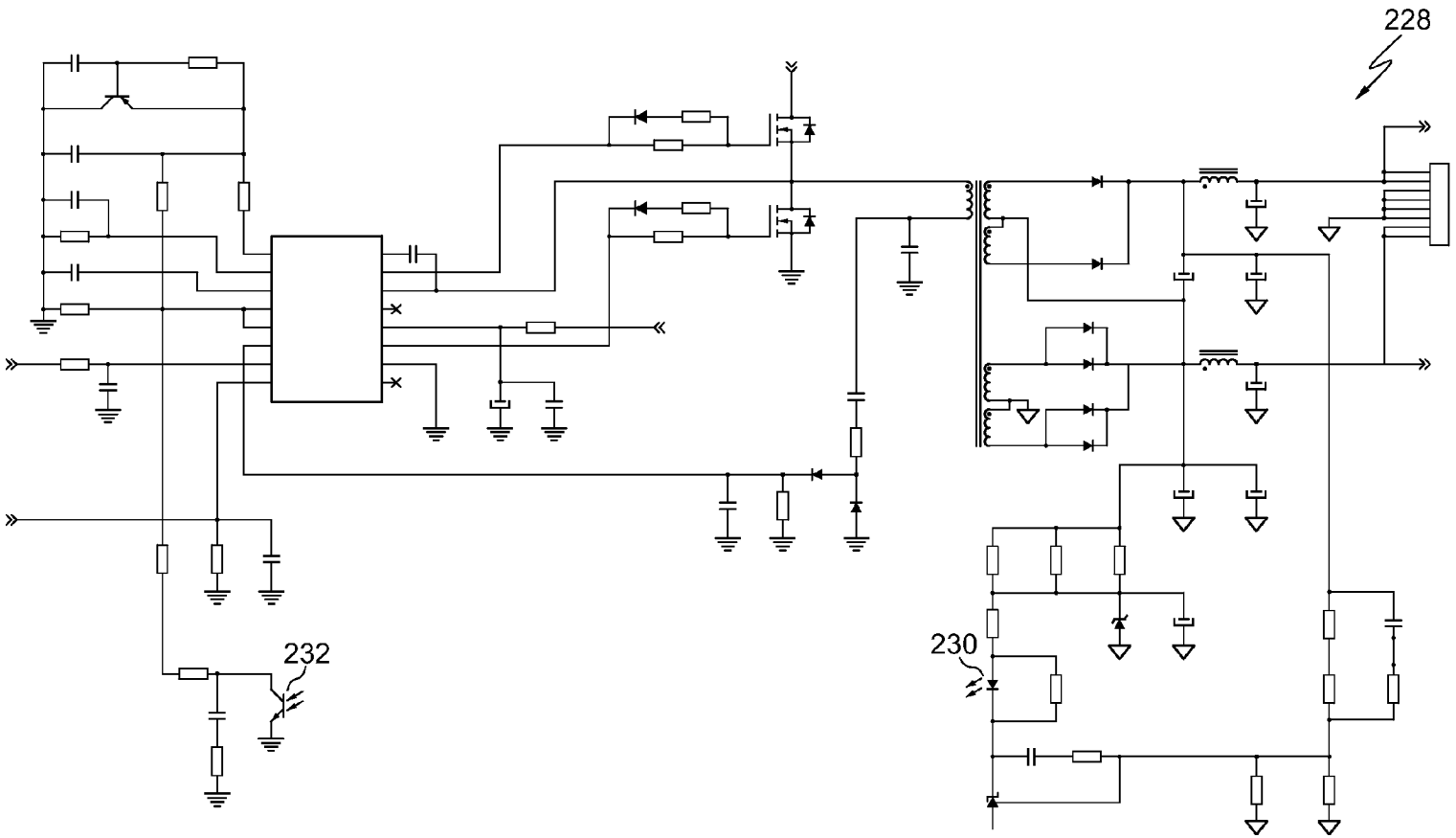
FIG. 13 is an electrical schematic of an implementation of an LLC resonant converter implementation.

Referring to FIG. 13, an electrical schematic of an implementation of an LLC resonant converter 228 is illustrated. This schematic is a design found in FIG. 2 of AN2509 Application Note "Wide Range 400 W (+200 V@1.6 A/+75@1 A) L6599-Based HB LLC Resonant Converter," published by STMicroelectronics, Inc., Rev. 3 (Apr. 23, 2007), which was included in the '689 application as Appendix F. The LLC resonant converter 228 illustrated in FIG. 13 is for the exemplary purposes of this disclosure only because in implementations of LLC resonant converters used for lighting system implementations like those disclosed in this document, the feedback provided by LED 230 and the photosensor 232 would be replaced by feedback from a Hall sensor (or an opto-isolator in particular implementations). Since implementations of lighting systems in this document rely on magnetic or voltage feedback rather than light feedback, the challenge of attempting to control the operation of multiple tubes at multiple intensities using photosensors for each tube may be avoided.

Figure 14:
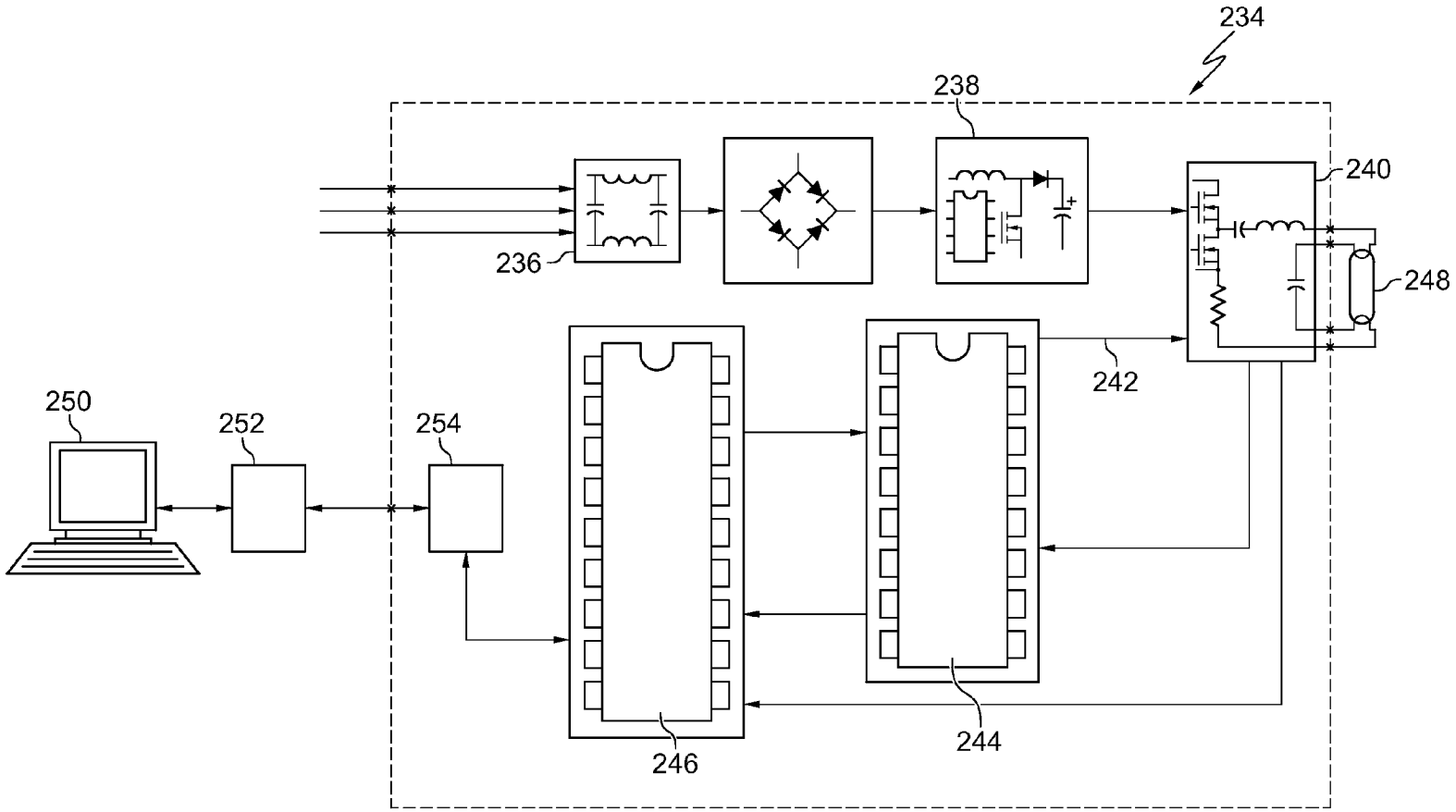
FIG. 14 is a block diagram of an implementation of a controller for a fluorescent tube.

Referring to FIG. 14, a schematic of an implementation of an EMI filter/PFC/EPS switcher/intensity selection circuit/controller combination 234 is illustrated for the exemplary purposes of this disclosure. This design comes from Fosler et al., "Digitally Addressable DALI Dimming Ballast," AN809, Microchip Technology, Inc. (2002) included as Appendix A to the '021 application. Since the combination 234 does not utilize an LLC resonant converter (or a remote transformer or charge pump), it would likely be unsuitable for gas discharge tube operation, but is included here for illustrative purposes. Power enters the EMI filter 236 and passes through PFC 238 before reaching EPS switcher 240. The EPS switcher 240 is driven by half bridge driver 242 which is incorporated into the intensity selection integrated circuit 244 which includes the intensity selection circuit. Microprocessor 246 acts as the controller, sending intensity information to the intensity selection integrated circuit 244 for processing by the intensity selection circuit which subsequently implements a duty cycle and switching frequency to produce the desired signal to drive fluorescent tube 248. Microprocessor 246 receives control information from a control computer 250 through interfaces 252, 254. The combination 234 illustrated in FIG. 14 demonstrates how integrated circuits can incorporate various components of the power conditioning and control systems and even the controller itself into single design units depending upon the type of lighting elements being utilized by the lighting system implementation.

Figure 15:
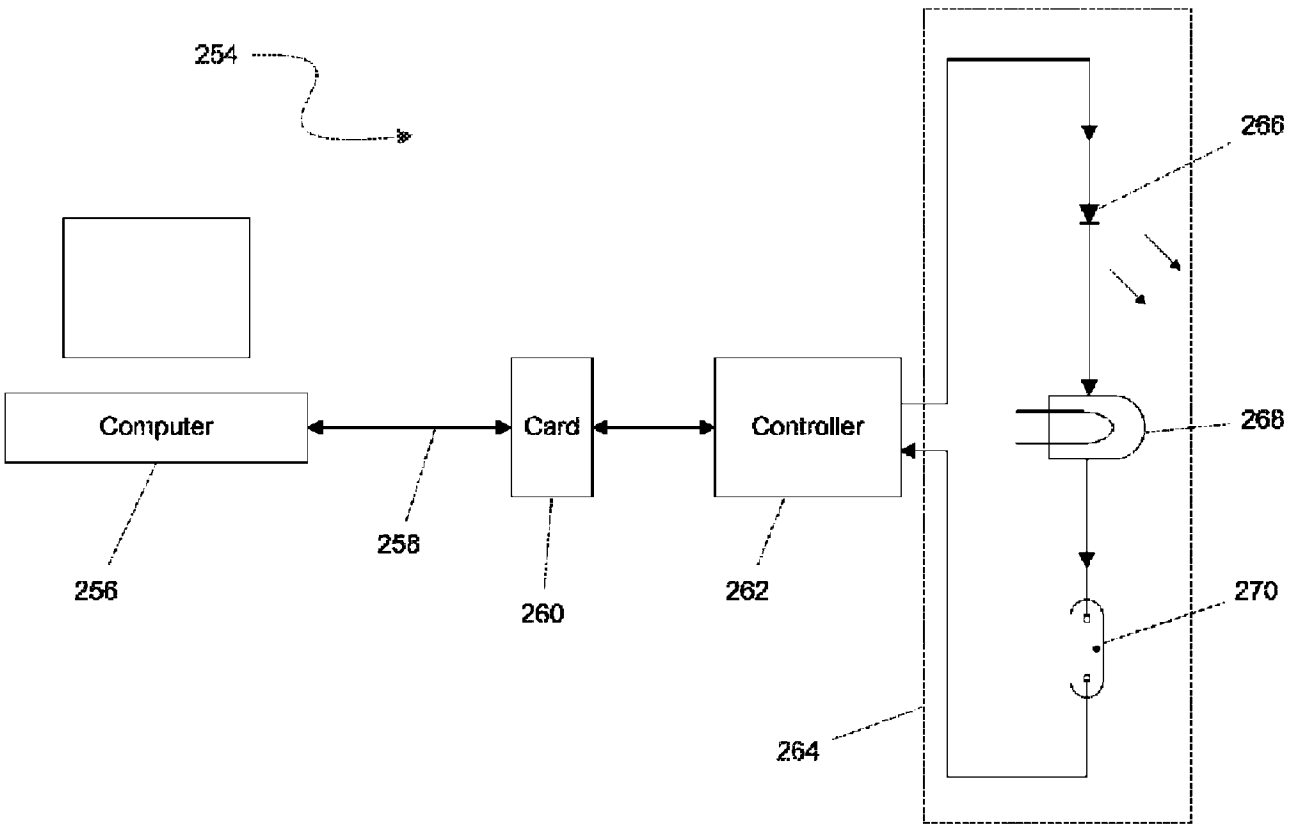
FIG. 15 is a block diagram of a fifth implementation of a lighting system including various lighting elements.

Referring to FIG. 15, a fifth implementation of a lighting system 254 is illustrated. The lighting system 254 includes a control computer 256 that may, in particular implementations, be operating using various implementations of visual presentation software applications. As further discussed in U.S. Utility Patent Application to Bowser et al., entitled "Visual Presentation System and Related Methods," application Ser. No. 12/425,214, filed Apr. 16, 2009 (the '214 application) previously incorporated by reference, the visual presentation software application may allow a user to place one or more visual notes on a visual staff and one or more dynamic elements adjacent to the one or more visual notes. The visual presentation software application then generates one or more visual element parameters and includes them in a control sequence 258 that may be formatted according to any of a wide variety of industry standard data transfer formats, including, by non-limiting example, Digitally Addressable Light Interface (DALI), DMX512-A, Ethernet Art-Net (such as by Artistic License of Harrow, Middlesex, UK), MIDI, or any other industry standard data transfer format.

As illustrated in FIG. 15, a daughter card 260 (adapter or conversion card) may be coupled with the control computer 256 and perform various needed conversions of the format of the control sequence 258 to allow a controller 262 to receive and retrieve the information from the visual element parameters contained in the control sequence 258. As in other controller implementations disclosed in this document, controller 262 receives the converted control sequence from the daughter card 260 and uses the information from the visual element parameters to operate lighting system 264, which may, as illustrated in FIG. 15, include one of or any combination of a wide variety of lighting elements, such as LEDs 266, halogen light bulbs 268, and gas discharge tubes 270. Any of the various power conditioning and control component implementations (PFCs, LLC resonant converters, EPS switchers) disclosed in this document may be utilized as part of the lighting system 264.

Figure 16A:
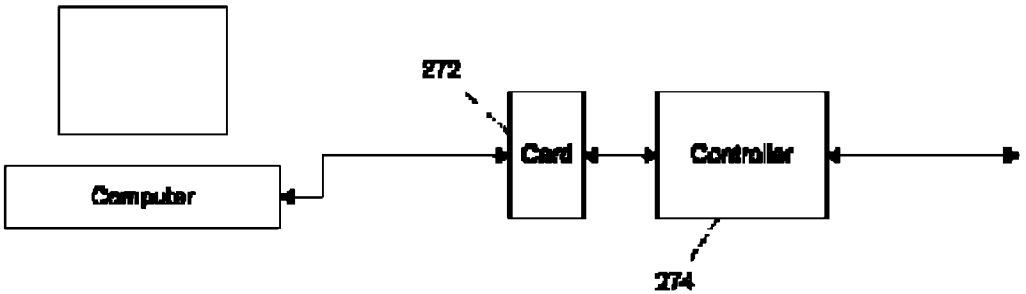
FIG. 16 A is a block diagram of a first implementation of a daughter card.
FIG. 16B is a block diagram of a second implementation of a daughter card.
FIG. 16C is a block diagram of a third implementation of a daughter card.
Figure 16B:
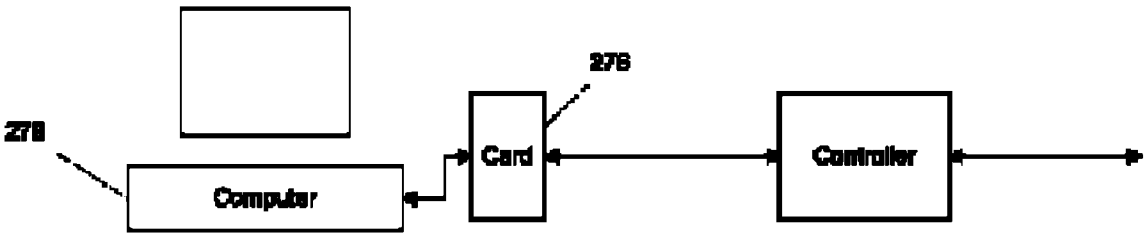
Figure 16C:
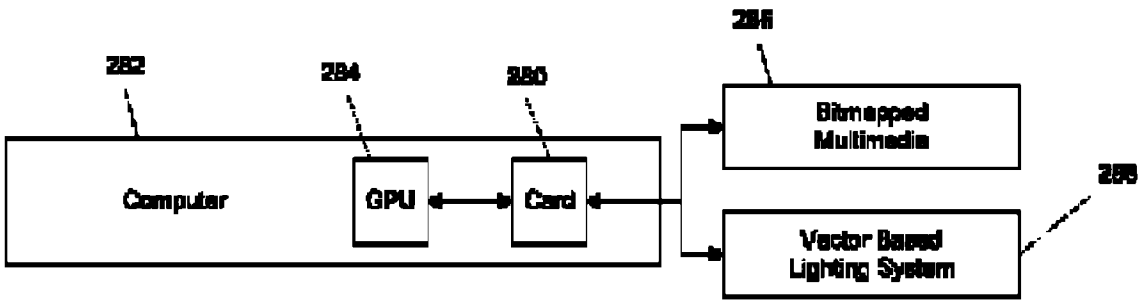

Referring to FIG. 16A, a block diagram of a first implementation of a daughter card 272 is illustrated. In this implementation, the daughter card 272 is closely associated with the controller 274 through, by non-limiting example, being incorporated into, coupled to the outside of, or housed in a separate enclosure adjacent to the controller 274. FIG. 16B illustrates a second implementation of a daughter card 276 which is, by non-limiting example, incorporated into, coupled to the outside of, or housed in a separate enclosure adjacent to control computer 278. When the daughter card 276 is incorporated into the control computer, the daughter card 276 may be coupled into a slot on a motherboard included in the control computer or may be integrated into the motherboard. In particular implementations, and referring to FIG. 16C, where the daughter card 280 is closely associated with the control computer 282, the daughter card 280 may interact with a graphics processing unit 284 (GPU) included in the control computer 282 which may implement some or all of the functions of the visual presentation software. In these implementations, the daughter card 280 may be a physical circuit board coupled with the motherboard, may be integrated as components on the motherboard, or may be implemented in one or more field programmable gate arrays (FPGAs) or application-specific integrated circuits (ASICs) on the motherboard.

In particular implementations, the functions of the daughter card 280 may be carried out entirely by software instructions operating on the GPU 284, a central processing unit within the control computer 282, or on both the GPU 284 and central processing unit. In these and other implementations of daughter cards and lighting systems disclosed in this document, the output of the daughter card may be bitmapped multimedia 286 used by either a bitmapped multimedia producing software application or computing system to create images on a visual display, or by a vector based lighting system 288, which may include any of the lighting system implementations disclosed in this document. Any of a wide variety of configurations are possible using the principles disclosed herein. Additional disclosure regarding the structure, use, and methods of operation of daughter cards and related system components may be found in the '685 application previously incorporated by reference.

Figure 17:
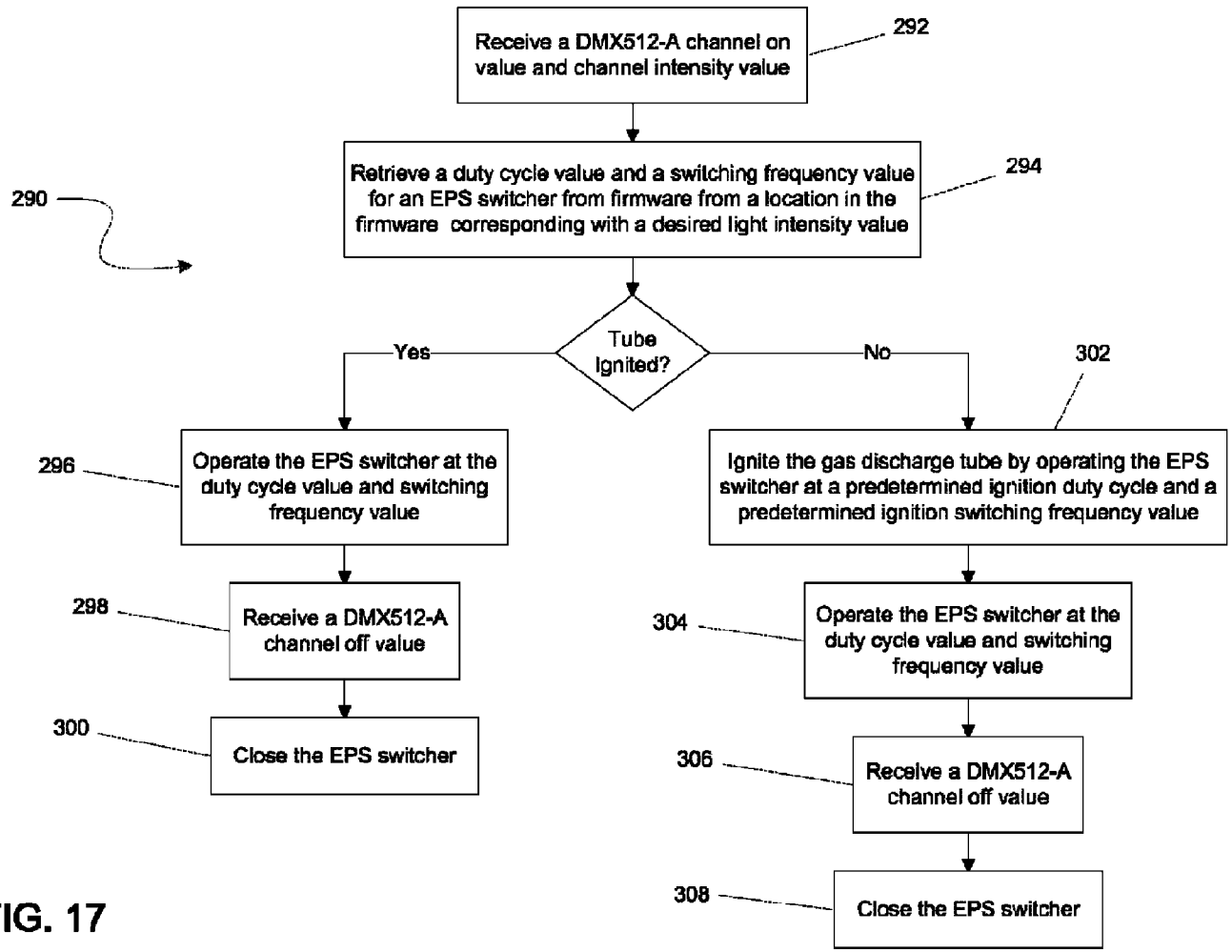
FIG. 17 is a flowchart of an implementation of a method of lighting a gas discharge tube to a desired light intensity.

Implementations of lighting systems like those disclosed herein may utilize and be used in a wide variety of method implementations. Referring to FIG. 17, a flow chart of an implementation of a method of lighting a gas discharge tube to a desired light intensity 290 is illustrated. The method 290 includes receiving a DMX512-A channel or other hardware protocol channel "on" value and channel intensity value (step 292) and retrieving a duty cycle value and a switching frequency value for an EPS switcher from firmware from a location in the firmware corresponding with a desired light intensity value (step 294). If the tube is already ignited and running (visibly lit), then the method 290 includes operating the EPS switcher at the duty cycle value and switching frequency value retrieved from the firmware (step 296), receiving a DMX512-A channel or other hardware protocol channel "off" value (step 298) and closing the EPS switcher (step 300). If the tube is not already ignited, the method 290 includes igniting the gas discharge tube by operating the EPS switcher at a predetermined ignition duty cycle value and a predetermined ignition switching frequency value (step 302).

When gas discharge tubes are used as lighting elements, the voltage level required to ignite the tube can be much higher than the voltage used to keep the tube lit (referred to as the run-time voltage). The voltage level needed to ignite a particular tube depends on many factors, including the length of the tube, the tube diameter, the type of gas, and the gas pressure in the tube. For example, an initial estimate of the voltage can be obtained by using an approximation that the run-time voltage value is about 250 to 300 V per foot of tube and the ignition voltage is about 1.5 to 2 times the run-time voltage level. Once the gas discharge tube has been ignited, the method 290 includes operating the EPS switcher at the duty cycle value and switching frequency value retrieved from the firmware (step 304), receiving a DMX512-A channel or other hardware protocol channel "off" value (step 306), and closing the EPS switcher (step 308). Relevant teachings regarding the particular format and use of DMX512-A and other communication protocols can be found in the '021 application.

Implementations of the method 290 may also include lighting the gas discharge tube to a flash intensity value by operating the EPS switcher at a flash duty cycle value and a flash switching frequency value. A flash intensity value can be up to 250% of a gas discharge tube's ordinary light intensity. The flash intensity is created by keeping a gas discharge tube in the ignition state as long as possible. This can be accomplished by using specific flash duty cycle and flash switching frequency values at the ignition voltage level or higher. Depending upon the electrical characteristics of the components in the charge pump, the capacitors in the charge pump may no longer charge and allow the applied power to flow through and excite the gas in the gas discharge tube to an excitation level above the normal run excitation level and above the ignition excitation level. For the exemplary purposes of this disclosure, a 16 inch long gas discharge tube may be operated at a flash intensity level for about one second or longer. The longer the tube, the shorter a time it may be operated at the flash intensity level. Additional information about the flash intensity level and the operating characteristics of and operation of gas discharge tubes may be found in Appendix D of the '021 application.

Figure 18:
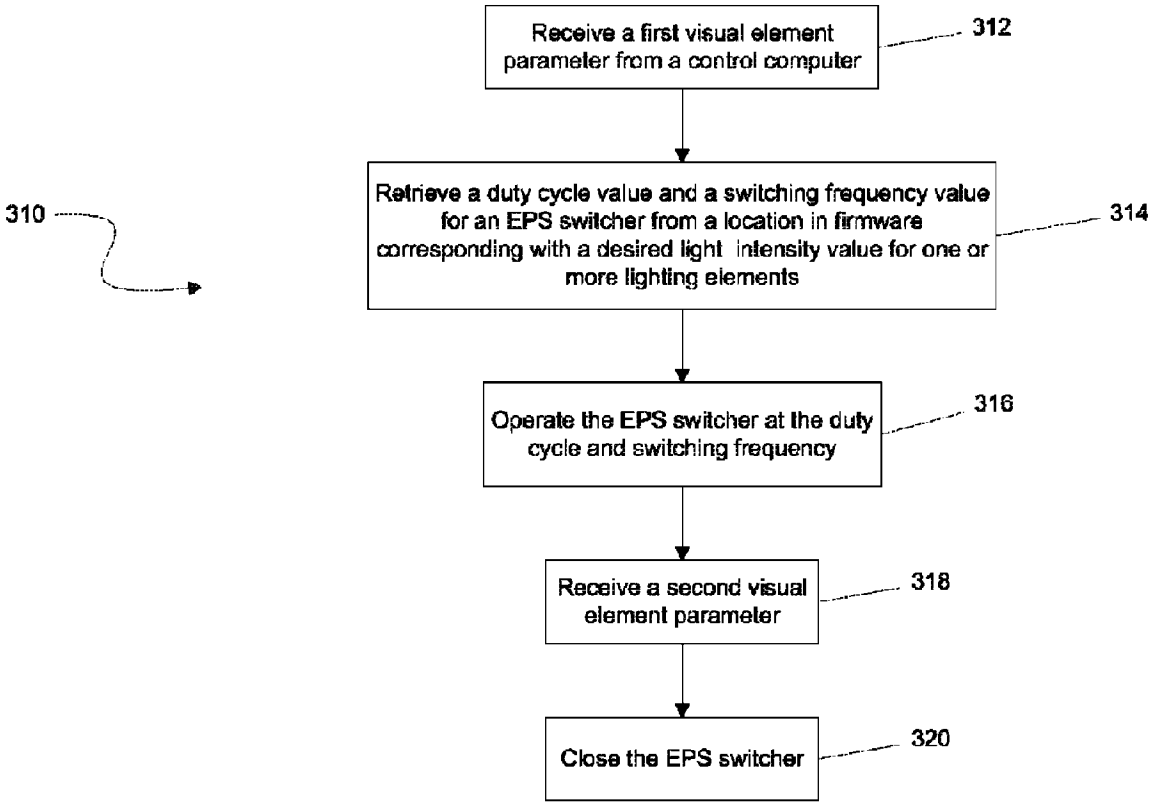
FIG. 18 is a flowchart of an implementation of a method of operating a lighting system.

Referring to FIG. 18, an implementation of a method of operating a lighting system 310 is illustrated. The method 310 includes receiving a first visual element parameter from a control computer (step 312), retrieving a duty cycle value and a switching frequency value for an EPS switcher from a location in firmware corresponding with a desired light intensity value for one or more lighting elements (step 314), operating the EPS switcher at the duty cycle and switching frequency retrieved (step 316), receiving a second visual element parameter (step 318), and closing the EPS switcher (step 320). The visual element parameters utilized in the method may be any disclosed in this document and the '214 application previously incorporated by reference and may be formatted using any of the industry standard formats disclosed in this document. Also, in some implementations, the duty cycle value may be a flash duty cycle value and the switching frequency value may be a flash switching frequency value. In these implementations, the flash duty cycle value and the flash switching frequency value are adapted to produce excitation of the one or more lighting elements above an operating level of excitation, and cause the lighting element to emit light at an intensity greater than the ordinary run condition. Examples of lighting elements that may be utilized in implementations of the method include, by non-limiting example, gas discharge tubes, halogen light bulbs, LEDs, fluorescent tubes, and any other electrically powered light source.

Figure 19:
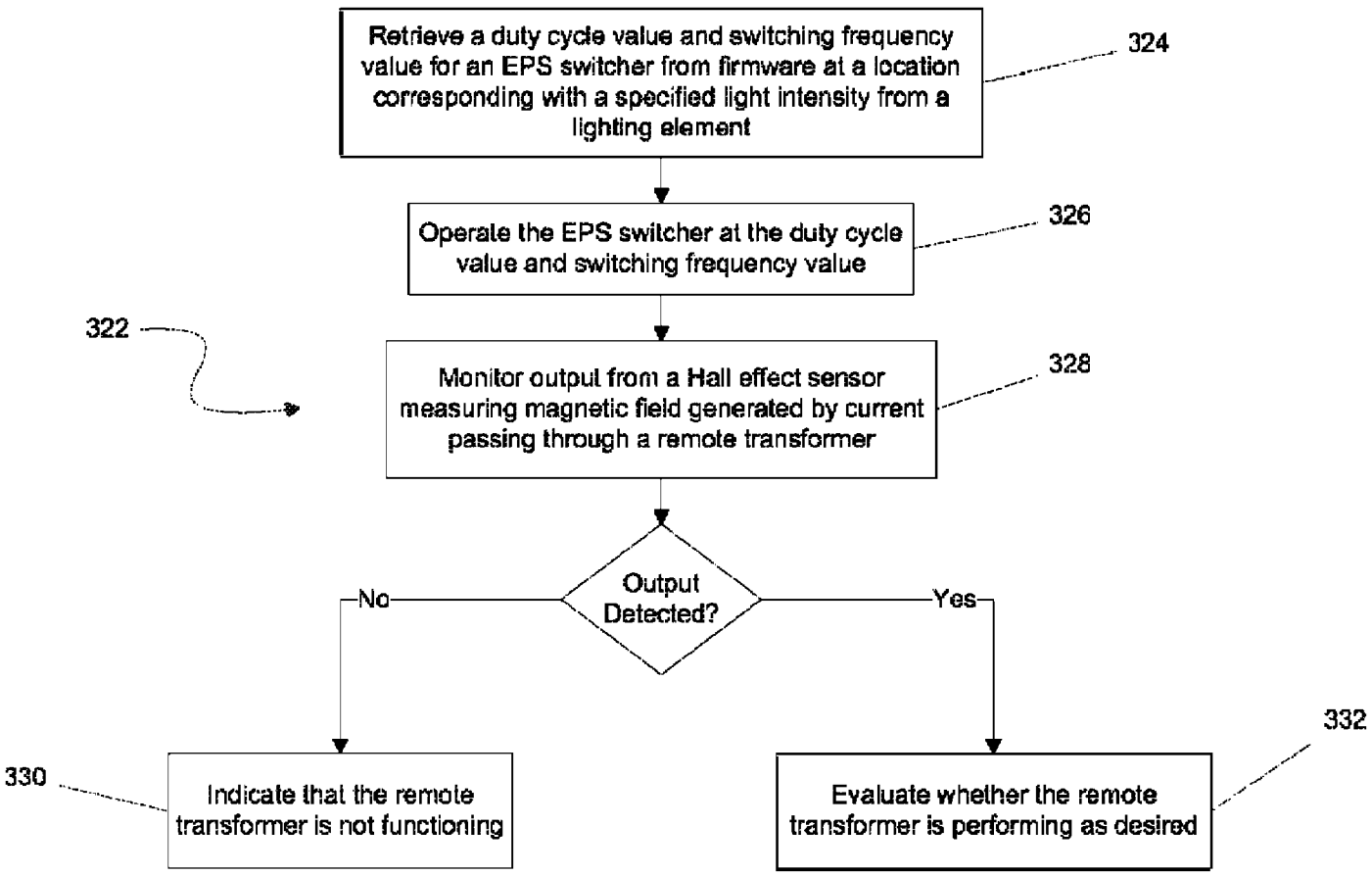
FIG. 19 is a flowchart of an implementation of a method of detecting and evaluating the operation of a remote transformer.

Referring to FIG. 19, an implementation of a method of detecting and evaluating the operation of a remote transformer 322 is illustrated. The method 322 includes retrieving a duty cycle value and switching frequency value for an EPS switcher from firmware at a location corresponding with a specified light intensity from a lighting element (step 324) and operating the EPS switcher at the duty cycle value and switching frequency value retrieved (step 326). The method 322 also includes monitoring output from a Hall effect sensor measuring magnetic field generated by current passing through a remote transformer (step 328). If output from the Hall effect sensor is not detected, the method includes indicating that the remote transformer is not functioning (step 330), which may take place through causing an error message to appear on a control computer, controller, or for a light or sound to appear or be emitted. If output from the Hall effect sensor is detected, in particular implementations of the method 322, the method 322 may further include evaluating whether the remote transformer is performing as desired (step 332). Additional examples of particular implementations of related methods are illustrated in FIGS. 4 and 5 in the '021 application and described therein.

Implementations of the method 322 may also include evaluating the performance of the remote transformer using a method such as, by non-limiting example, differencing, comparing median values, least squares fitting, analysis of variance (ANOVA) techniques, variance comparisons, standard deviation comparisons, and statistical control charts. With this information, changes to calibrated values, duty cycle values, switching frequency values or any other parameter related to the operation of the lighting system may be made. In particular implementations where opto-isolators are present, the method 322 may further include monitoring output from an opto-isolator coupled to a charge pump coupled to the remote transformer, and if output is not detected from the opto-isolator during operation of the EPS switcher, indicating the remote transformer, the charge pump, or the remote transformer and the charge pump are not working. If output is detected from the opto-isolator, then the method may include evaluating the output to determine whether the remote transformer, the charge pump, or the remote transformer and the charge pump are not performing as desired. The process of evaluating the output from the opto-isolator may take place using any of the methods previously mentioned for the Hall effect sensor output.

Figure 20:
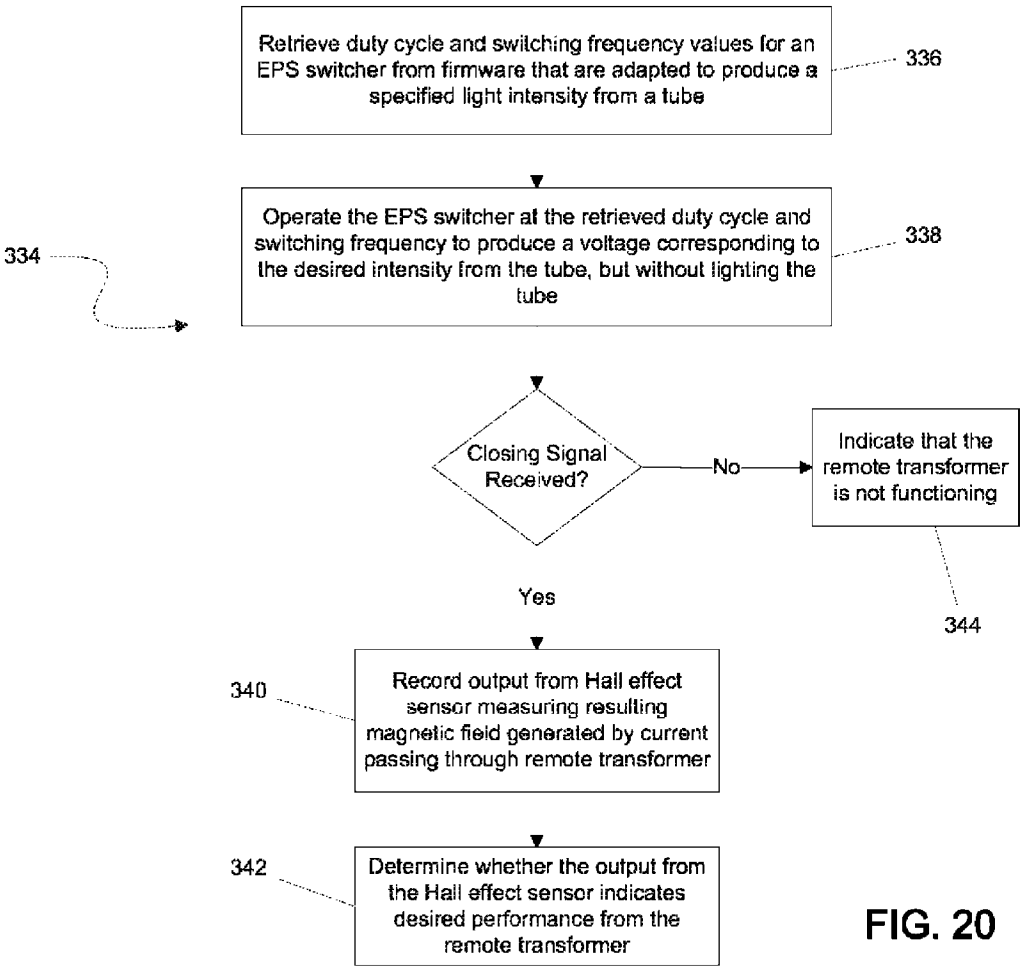
FIG. 20 is a flowchart of an implementation of a method of testing the performance of a lighting system containing a gas discharge tube.

Referring to FIG. 20, an implementation of a method of testing the performance of a remote transformer 334 is illustrated. The method 334 includes retrieving duty cycle and switching frequency values for an EPS switcher from firmware that are adapted to produce a specified light intensity from a tube (step 336) and operating the EPS switcher at the retrieved duty cycle and switching frequency to produce a voltage corresponding to the desired intensity from the tube, but without lighting the tube (step 338). If a closing signal is received from an opto-isolator (i.e., the voltage potential in one of the circuits passing through the opto-isolator is sufficient to cause an LED within the opto-isolator to light), the method includes recording output from a Hall effect sensor measuring resulting magnetic field generated by current passing through a remote transformer (step 340) and determining whether the output from the Hall effect sensor indicates desired performance from the remote transformer (step 342). If a closing signal is not received, then the method 334 includes indicating that the remote transformer is not functioning (step 344). Implementations of the method 344 may be used to test the functionality various components of the lighting system prior to activation without requiring ignition of gas discharge tubes or other lighting elements.

Figure 21:
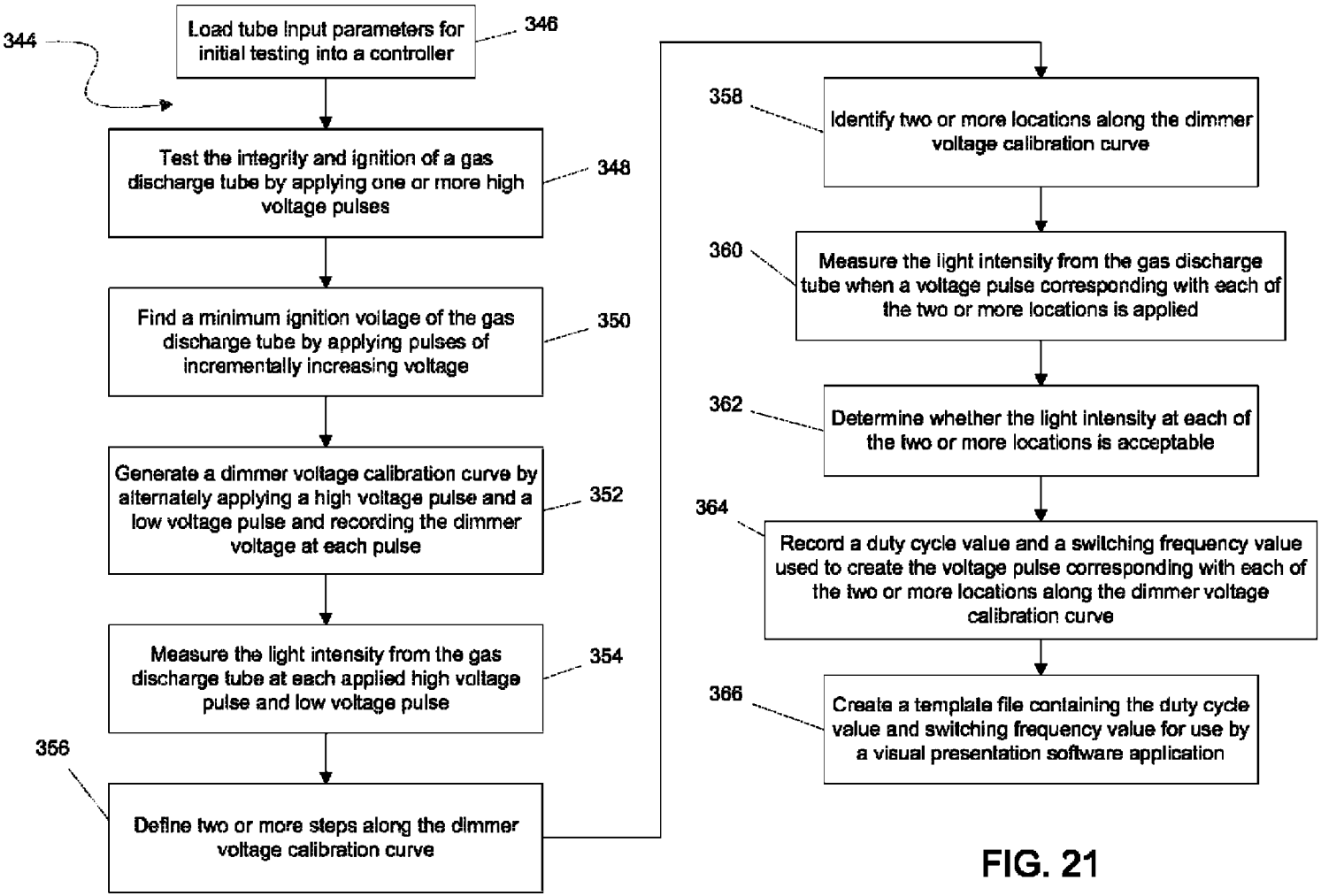
FIG. 21 is a flowchart of a first implementation of a method of calibrating a gas discharge tube included in a lighting system.

Referring to FIG. 21, a first implementation of a method of calibrating a gas discharge tube included in a lighting system 344 is illustrated. As illustrated, the method includes loading tube input parameters for initial testing into a controller (step 346). These may include the tube manufacturer, gas type, gas pressure, tube diameter, tube length, and any other characteristic of the tube that affects the ignition and performance of the tube. The method 344 also includes testing the integrity and ignition of a gas discharge tube by applying one or more high voltage pulses (step 348) and finding a minimum ignition voltage of the gas discharge tube by applying pulses of incrementally increasing voltage (step 350). The tube input parameters may be used to create an estimate of a minimum ignition voltage in particular implementations. The method 344 also includes generating a dimmer voltage calibration curve by alternately applying a high voltage pulse and a low voltage pulse and recording the dimmer voltage at each pulse (step 352). The dimmer voltage may be recorded and utilized by implementations of intensity selection circuits like those disclosed in this document.

The method 344 also includes measuring the light intensity from the gas discharge tube at each applied high voltage pulse and low voltage pulse (step 354), defining two or more steps along the dimmer voltage calibration curve (step 356), and identifying two or more locations along the dimmer voltage calibration curve (step 358). A microprocessor may be used to subdivide the dimmer voltage calibration curve into various steps, and two or more of those steps may be selected for additional testing. The method 344 includes measuring the light intensity from the gas discharge tube when a voltage pulse corresponding with each of the two or more locations is applied (step 360), determining whether the light intensity at each of the two or more locations is acceptable (step 362), and recording a duty cycle value and a switching frequency value used to create the voltage pulse corresponding with each of the two or more locations along the dimmer voltage calibration curve (step 364). The method 344 may also include creating a template file containing the duty cycle value and switching frequency value for use by a visual presentation software application (step 366). Since each lighting system may contain a collection of light elements that differ from each other, a visual presentation software application may use the parameters in the template file for a particular lighting system in order to generate the proper visual element parameters to include in the control sequence sent to the controller during composition and/or operation. The calibration results allow control computer operating a visual presentation software application to know how to implement the visual notes and dynamic elements on the visual staff and ensure that the lighting elements become visible at the right times.

The calibration method disclosed above may be extended and iteratively performed to account for the interactions of the various lighting elements with each other during operation. Various algorithms to perform iterative calibration of the lighting elements may be employed to ensure that on average, the lighting system will be able to provide the desired light intensity levels at the proper times.

Figure 22:
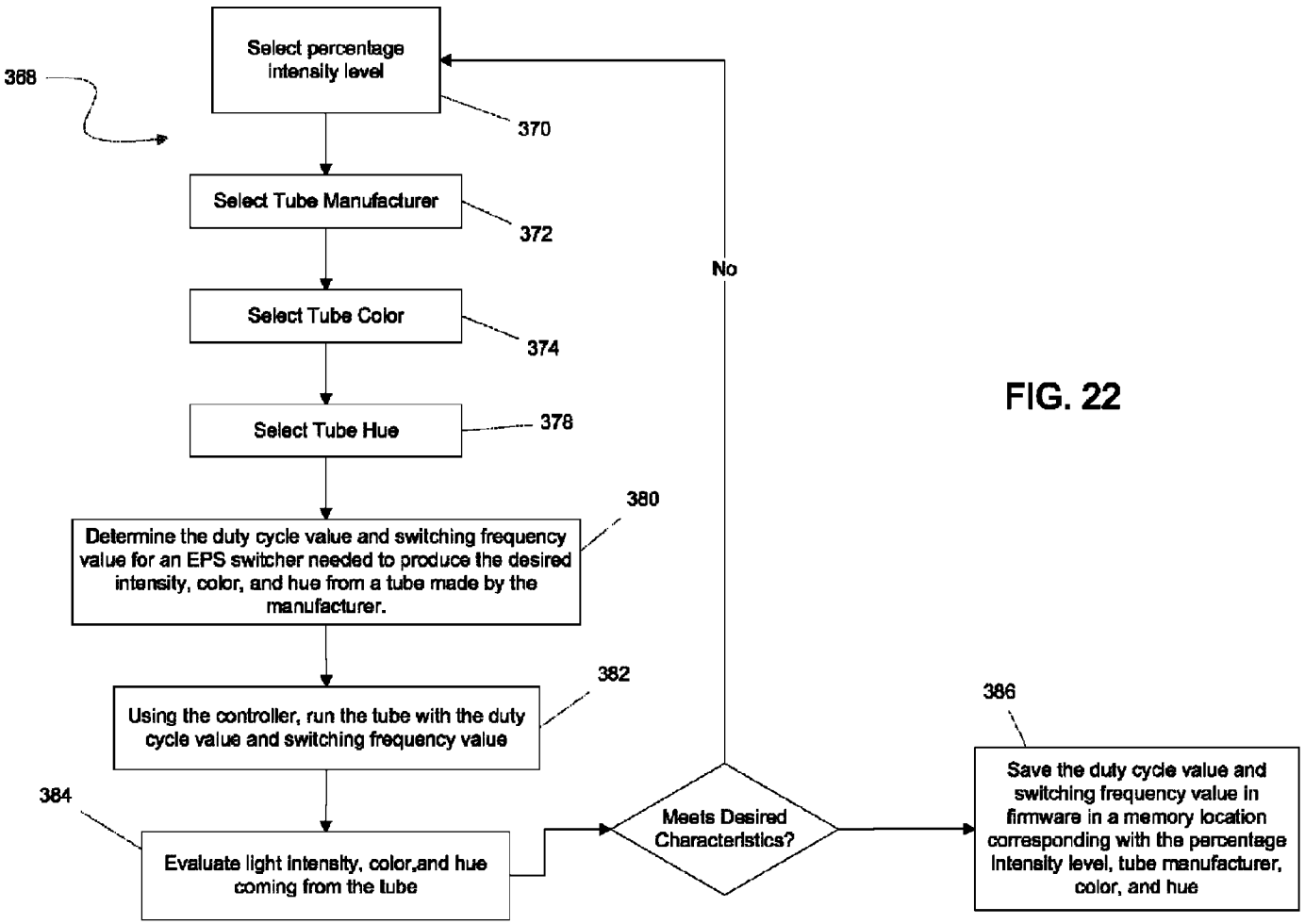
FIG. 22 is a flowchart of a second implementation of a method of calibrating a gas discharge tube included in a lighting system.

Referring to FIG. 22, a second implementation of a method of calibrating a gas discharge tube included in a lighting system 368 is illustrated. As illustrated, the method 368 includes selecting a percentage light intensity level (step 370), a gas discharge tube manufacturer (step 372), a tube color (step 374), a tube hue (step 378), and determining a duty cycle and switching frequency value for an EPS switcher needed to produce the desired intensity, color, and hue from a tube made by the selected manufacturer (step 380). The method 368 also includes running the tube with the duty cycle and switching frequency value using a controller (step 382) and evaluating the light intensity, color, and hue coming from the gas discharge tube (step 384). If the light intensity, color, and hue meet desired levels and/or characteristics, then the method 368 includes saving the duty cycle values and switching frequency values in firmware in a memory location corresponding with the percentage intensity level, tube manufacturer, color, and hue (step 386). If the light intensity, etc. does not meet what is desired, then the method 368 includes iteratively moving through the steps of the method until a desirable output has been created and duty cycle values and switching frequency values have been saved to firmware.

Figure 23A:
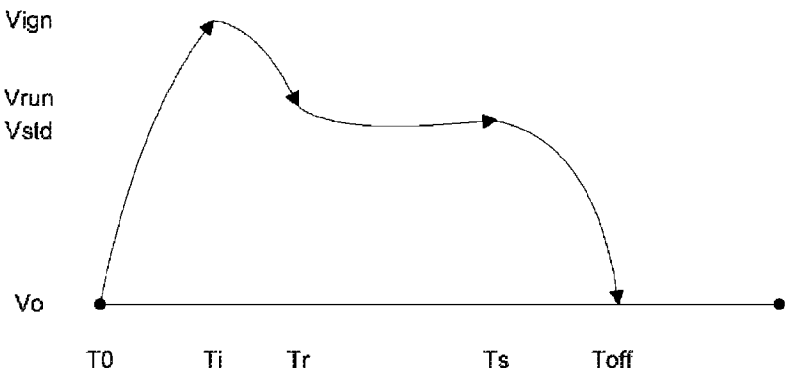
FIG. 23A is a graph of voltage over time for a gas discharge tube.

Referring to FIG. 23A, graph of voltage over time for a gas discharge tube is illustrated, showing the cycle of operation of the tube from a non-energized state (T0) to an off state (Toff). Graphs like those in FIG. 23A may be created during calibration of lighting systems including gas discharge tubes in order to develop parameters for template files including look up tables to capture the variables that can be used to describe the non-instantaneous nature of lighting a gas discharge tube. As illustrated, a period of time from T0 to Ti is required for the gas discharge tube to reach the ignition voltage (Vign) and ignite. An additional period of time from Ti to Tr is required for the gas discharge tube to reach its run voltage level (Vrun) and level off at the steady state voltage level Vstd. An additional period of time from Ts to Toff is required before the gas discharge tube is fully off.

In view of the time delays involved in operating a gas discharge tube, one of the parameters collected during calibration may include creating a graph of voltage over time (like those illustrated in FIGS. 23A and 23B) for each gas discharge tube in the lighting system implementation. With these graphs, time offsets for each tube that capture the time to ignition and the time to steady state operation at a given intensity level can be recorded, as well as the time to shut off. Knowing these times can be very important when the gas discharge tube is asked to turn on and off quickly or to change intensity levels rapidly in response to dynamic elements or visual notes. Additional descriptions of a graph like the one illustrated in FIG. 23A may be found in Appendix F in the '021 application.

Figure 23B:
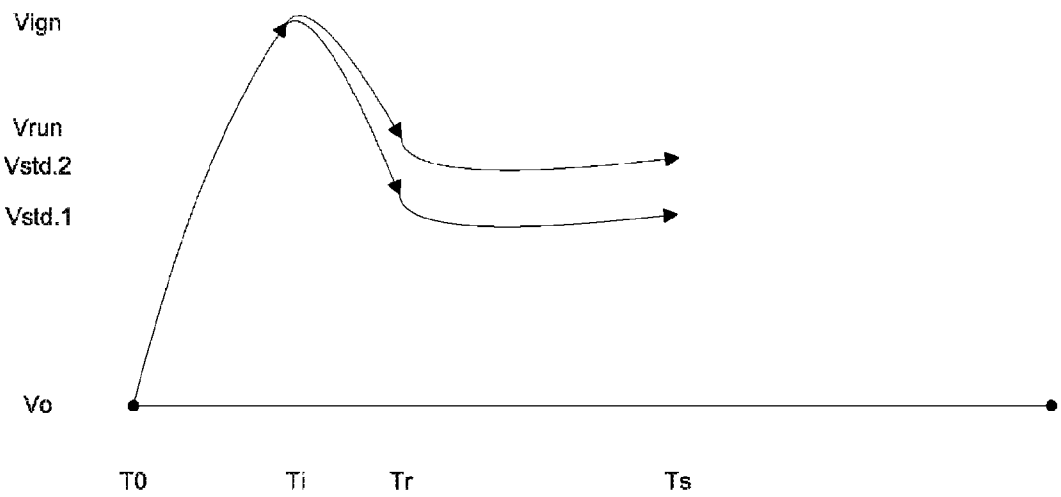
FIG. 23B is a graph of voltage over time for a gas discharge tube operating near one or more other gas discharge tubes.

While the V0 voltage value in FIG. 23 A is shown as being zero, during operation of a lighting system involving more than one gas discharge tube, the V0 voltage may not actually be zero potential. This is because of the energy levels created on the surface of the tube and in other areas due to the high voltage being applied to other tubes and present in the enclosure where the gas discharge tube is located. Also, voltage potential can be created when tubes run parallel or cross each other depending upon the diameter, gas type, gas pressure, and electrode size of the respective gas discharge tubes. Referring to FIG. 23B, another graph of voltage over time for a gas discharge tube operating in near another gas discharge tube is illustrated. The fact that the V0 voltage potential may not be zero may create an operating situation where it may be desirable to target maintaining the voltage applied to the gas discharge tube between a range of values, to ensure that the tube operates properly whether another gas discharge tube adjacent to it is running or not. As shown in the graph, the effect of the non-zero voltage can be seen in the two different steady state run voltages Vstd.1 and Vstd.2, one being required when an adjacent tube is not running and the other when an adjacent tube is operating, for example. During calibration, the difference in the curves could be used to determine an intermediate run voltage that should be applied to account for the differences caused by the change in V0. This difference can be included in a look up table and template file that a visual presentation software application can use to ensure that the gas discharge tube maintains the proper run voltage and light intensity level during operation.

Figure 24:
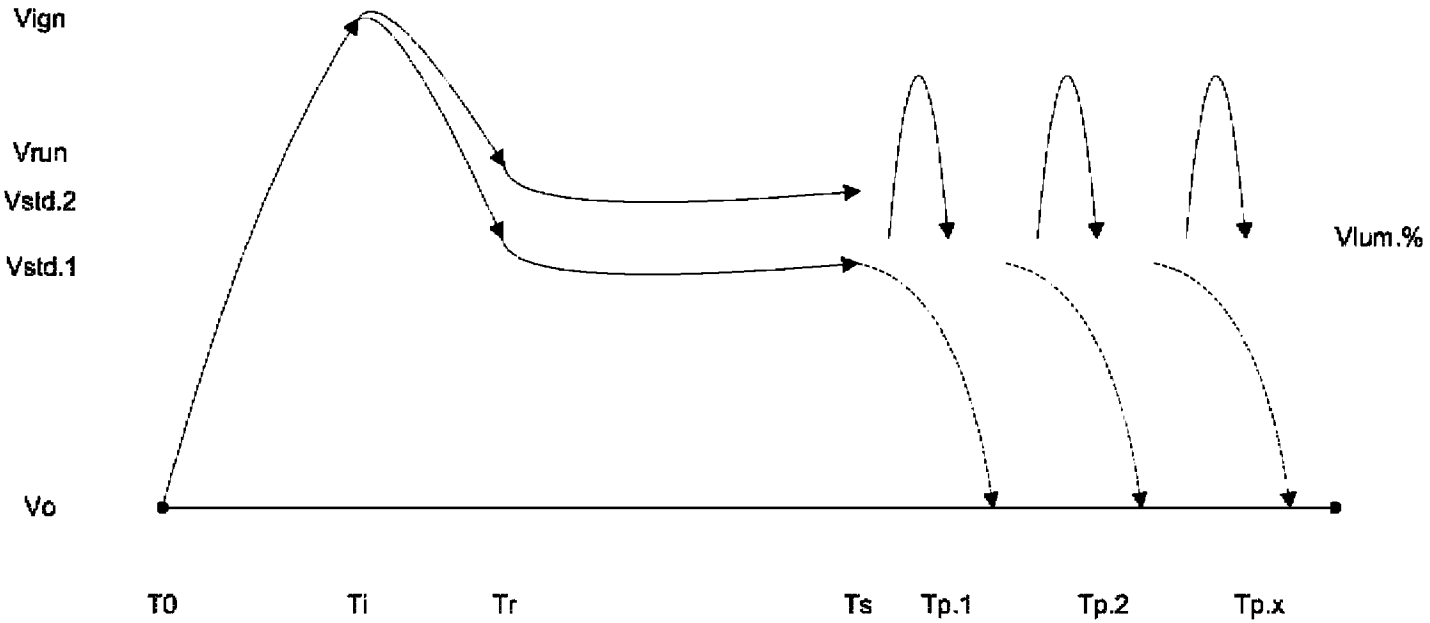
FIG. 24 is a graph of voltage over time showing voltage pulses applied at time periods.

Referring to FIG. 24, another voltage over time graph is illustrated illustrating how such a graph can be used to determine the voltage pulse frequency needed to maintain the steady state run voltage for a gas discharge tube between a range of voltage values. Without applying a voltage pulse at Tp.1, the voltage of the tube would drop starting at Ts and following the dotted curved line as the gas discharge tube fully discharged. By applying the pulse, the average voltage applied to the tube remains within the range between Vstd.1 and Vstd.2. During calibration, the length of time that a voltage pulse should be applied to ensure that the average voltage applied to a gas discharge tube remains within a specified range as well as the time at which each pulse should be applied can be collected and stored in a look up table, firmware, and/or a template file usable by a visual presentation software application. With the proper duty cycle values, switching frequency values, and knowledge of the timing associated with each of the tubes in a particular lighting system, the visual presentation software can ensure that the gas discharge tubes will reach the desired light intensity levels at the proper times.

Figure 25:
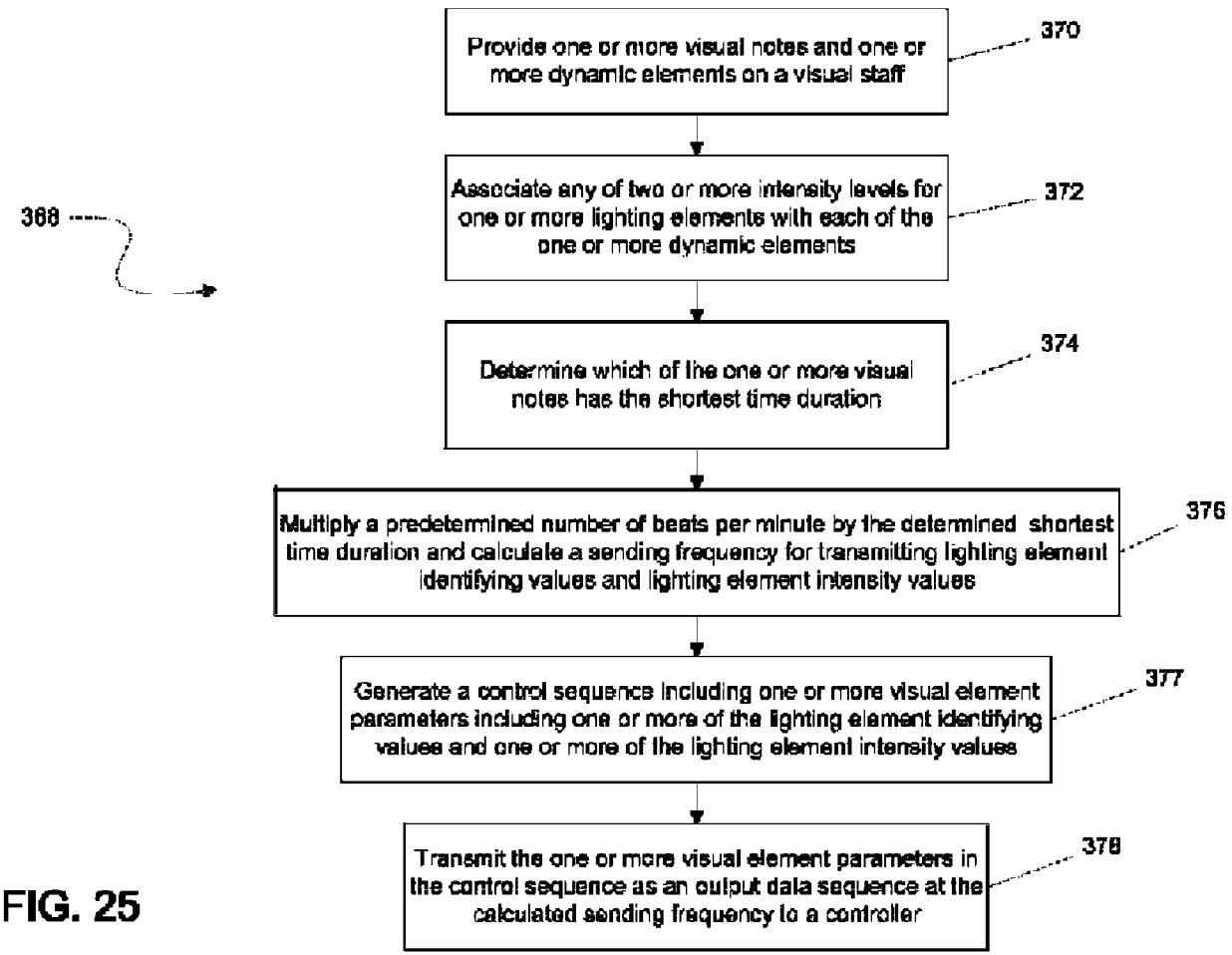
FIG. 25 is a flow chart of an implementation of a method of generating visual element parameters in a control sequence.

Referring to FIG. 25, an implementation of a method of generating visual element parameters in a control sequence 368 is illustrated. The method 368 includes providing one or more visual notes and one or more dynamic elements on a visual staff (step 370), associating any of two or more intensity levels for one or more lighting elements with each of the one or more dynamic elements (step 372), and determining which of the one or more visual notes has the shortest time duration (step 374). The method 368 also includes multiplying a predetermined number of beats per minute by the determined shortest time duration and calculating a sending frequency for transmitting lighting element identifying values and lighting element intensity values (step 376). The method 368 includes generating a control sequence including one or more visual element parameters including one or more of the lighting element identifying values and one or more of the lighting element intensity values (step 377) and transmitting the one or more visual element parameters in the control sequence as an output data sequence at the calculated sending frequency to a controller (step 378). Implementations of the method 368 may be used for lighting elements that include LEDs, halogen light bulbs, gas discharge tubes, and fluorescent tubes. The visual element parameters included in the control sequence may be formatted using any of the standards mentioned in this document. Additional disclosure regarding visual element parameters, control sequences, visual notes, and visual staffs may be found in the '214 application.

In places where the description above refers to particular implementations of lighting systems and related methods, it should be readily apparent that a number of modifications may be made without departing from the spirit thereof and that these implementations may be applied to other lighting system implementations and related method implementations.

The invention claimed is:

1. A method of generating visual element parameters in a control sequence, the method comprising:

providing one or more visual notes on a visual staff and one or more dynamic elements adjacent to the one or more visual notes;

associating any of two or more intensity levels for one or more lighting elements included in a lighting system with each of the one or more dynamic elements;

determining which of the one or more visual notes has the shortest time duration;

multiplying a predetermined number of beats per minute by the shortest time duration and calculating a sending frequency for transmitting lighting element identifying values and lighting element intensity values;

generating a control sequence including one or more visual element parameters using the one or more visual notes and the one or more dynamic elements, the visual element parameters including one or more of the lighting element identifying values and one or more of the lighting element intensity values; and transmitting the one or more visual element parameters in the control sequence as an output data sequence at the calculated sending frequency to a controller coupled to the lighting system.

2. The method of claim 1, wherein associating any of two or more intensity levels for one or more lighting elements included in a lighting system further includes associating any of two or more intensity levels for one or more lighting elements selected from the group consisting of light emitting diodes (LEDs), halogen light bulbs, gas discharge tubes, and fluorescent tubes.

3. The method of claim 1, wherein generating a control sequence including one or more visual element parameters further includes generating a control sequence including one or more visual element parameters formatted in a Musical Instrument Digital Interface (MIDI), DMX512-A, MIDI Timecode (MTC), Ethernet Art-Net, and a Society of Motion Picture and Television Engineers (SMPTE) standard.

* * * * *